US010913558B2

(12) United States Patent
Ponti

(10) Patent No.: US 10,913,558 B2
(45) Date of Patent: Feb. 9, 2021

(54) FOLDING STATION OF A CARDBOARD BLANK AND A MACHINE FOR PACKING AN ARTICLE INTERNALLY OF A CARDBOARD BOX OBTAINED FROM THE CARDBOARD BLANK

(71) Applicant: F.L. AUTO S.R.L., Rome (IT)

(72) Inventor: Giuseppe Ponti, Cerbara-Citta' di Castello (IT)

(73) Assignee: F.L. AUTO S.R.L., Rome (IT)

( * ) Notice: Subject to any disclaimer, the term of this patent is extended or adjusted under 35 U.S.C. 154(b) by 239 days.

(21) Appl. No.: 16/303,049

(22) PCT Filed: May 16, 2017

(86) PCT No.: PCT/IB2017/052881
§ 371 (c)(1),
(2) Date: Nov. 19, 2018

(87) PCT Pub. No.: WO2017/203393
PCT Pub. Date: Nov. 30, 2017

(65) Prior Publication Data

US 2019/0300210 A1 Oct. 3, 2019

(30) Foreign Application Priority Data

May 24, 2016 (IT) ..... 102016000053162

(51) Int. Cl.
*B31B 50/00* (2017.01)
*B65B 5/02* (2006.01)
(Continued)

(52) U.S. Cl.
CPC ..... *B65B 5/024* (2013.01); *B31B 50/00* (2017.08); *B65B 7/16* (2013.01); *B65B 43/10* (2013.01);
(Continued)

(58) Field of Classification Search
CPC ..... B65B 5/024; B65B 7/16; B31B 50/00; B31B 2100/00; B31B 2100/0026; B65D 5/00; B65D 5/20; B65D 5/2095
(Continued)

(56) References Cited

U.S. PATENT DOCUMENTS 2,125,147 A 7/1938 Bergstein
3,986,319 A * 10/1976 Puskarz ..... B65B 11/004 53/447
(Continued)

FOREIGN PATENT DOCUMENTS

FR 1436851 A 4/1966
WO WO 2014/033624 A1 3/2014

*Primary Examiner* — Chelsea E Stinson
(74) *Attorney, Agent, or Firm* — R. Neil Sudol; Henry D. Coleman

(57) ABSTRACT

A folding station includes an inlet and an outlet and is predisposed to receive at the inlet a cardboard blank having two transversal edges, two longitudinal edges, two longitudinal score lines, and four transverse score lines. The two longitudinal score lines define therebetween a central sector and also define two lateral sectors externally of the two longitudinal score lines. Cuts in the two lateral sectors define a series of flaps. The folding station further comprises a conveyor for transporting the cardboard blank in an advancement direction to a position, a first folding bar located by a flank of a first side of the conveyor at the position, and a second folding bar located by a flank of a second side of the conveyor at the position. The first folding bar and the second folding bar rotate to fold the flaps in the two lateral sectors onto respective portions of the central sector of the cardboard blank.

13 Claims, 16 Drawing Sheets

(51) Int. Cl.

| | |
|---|---|
| ***B65B 7/16*** | (2006.01) |
| ***B65B 43/10*** | (2006.01) |
| ***B65D 5/20*** | (2006.01) |
| ***B65D 5/42*** | (2006.01) |
| ***B65D 5/44*** | (2006.01) |
| *B31B 120/00* | (2017.01) |
| *B31B 100/00* | (2017.01) |
| *B31B 120/10* | (2017.01) |
| *B31B 50/52* | (2017.01) |
| *B31B 110/35* | (2017.01) |
| *B31B 50/81* | (2017.01) |

(52) U.S. Cl.
CPC ..... *B65D 5/20* (2013.01); *B65D 5/2095* (2013.01); *B65D 5/4266* (2013.01); *B65D 5/443* (2013.01); *B31B 50/52* (2017.08); *B31B 50/81* (2017.08); *B31B 2100/00* (2017.08); *B31B 2100/0026* (2017.08); *B31B 2110/35* (2017.08); *B31B 2120/004* (2017.08); *B31B 2120/102* (2017.08); *B31B 2120/502* (2017.08); *B65B 2210/04* (2013.01)

(58) Field of Classification Search
USPC ..... 53/547
See application file for complete search history.

(56) References Cited

U.S. PATENT DOCUMENTS

| | | | | |
|---|---|---|---|---|
| 5,964,686 | A * | 10/1999 | Bidlack | B26D 1/185 493/160 |
| 10,836,517 | B2 * | 11/2020 | Ponti | B65B 51/02 |
| 2015/0224731 | A1 * | 8/2015 | Ponti | B65B 57/12 493/59 |
| 2020/0031083 | A1 * | 1/2020 | Ponti | B31B 50/20 |
| 2020/0031084 | A1 * | 1/2020 | Ponti | B65B 5/024 |
| 2020/0031506 | A1 * | 1/2020 | Ponti | B65B 5/024 |
| 2020/0039168 | A1 * | 2/2020 | Ponti | B31B 50/54 |

* cited by examiner

FOLDING STATION OF A CARDBOARD BLANK AND A MACHINE FOR PACKING AN ARTICLE INTERNALLY OF A CARDBOARD BOX OBTAINED FROM THE CARDBOARD BLANK

FIELD OF THE INVENTION

The present invention relates to the particular technical sector concerning packaging and packing of articles internally of a cardboard box.

In particular the present invention relates to a folding station for folding and forming a cardboard blank and a machine for realising a packing of an article internally of a cardboard box obtained from the cardboard blank

DESCRIPTION OF THE PRIOR ART

In the sector of logistics and goods dispatching, the need to pack and package the goods to be dispatched is known, in relative cardboard boxes, with the purpose of protecting and safeguarding them.

The Applicant has realised a special cardboard box for packaging articles, usable for forming a cardboard box with reinforced walls for packing and packaging an article internally thereof, so as to give a special protection and resistance against impacts, and the Applicant also set up special operating procedures for obtaining and realising, from a cardboard sheet, on the basis of the effective dimensions of the article to be packed, the relative cardboard blank and enveloping it about the article so as to package it internally of a box.

The Applicant is the owner of Italian patent application no. 102015000014902 of 13 May 2015 in which the special shape of a cardboard blank for packaging utilizable for the packaging of articles is described.

The cardboard blank (C) for packing disclosed by this patent application, and illustrated in FIG. 1, is obtained from a cardboard sheet, for example undulated, which is cut from a continuous strip of cardboard and then subjected to scoring and cutting operations for achieving the special shape of the illustrated cardboard blank.

A possible sequence of operations with which the cardboard blank illustrated in FIG. 1 can be folded so as to realise a packaging box with a relative article internally thereof is illustrated in the sequence of FIGS. 1A-1F, and also described in the above-mentioned patent application belonging to the Applicant.

The cardboard blank (C) has a quadrilateral shape, which can be for example square or preferably rectangular, with two transversal edges (B1, B2) and two longitudinal edges (BL), and comprises, at a first transversal edge (B1) and a second transversal edge (B2), two longitudinal folding lines (L1, L2), parallel to one another: the two longitudinal score lines (L1, L2) identify, in the cardboard sheet, a central sector (SC) and two lateral sectors (SL1, SL2).

Usually, the articles to be packed and dispatched are either predisposed in containers having a parallelepiped shape, with a quadrangular or rectangular base.

The two longitudinal score lines (L1, L2) are realised on the cardboard blank (C) distanced from one another on the basis of the effective dimensions of the base of the article to be packed, for example on the basis of the length of the base of the article.

The cardboard blank (C) further comprises four transversal score lines (T1, T2, T3, T4), parallel to one another and such as to identify, on the central sector (SC) of the cardboard blank (C) and between the two transversal edges (B1, B2), five portions (P1, P2, P3, P4, P5).

The four transversal score lines (T1, T2, T3, T4)) are made so as to be distanced from one another as a function of the effective dimensions of the article to be packed, in particular on the basis of the width (I) of the base of the article, the width (L*) of the upper face and the height (H) of the flanks of the article.

In detail, starting from a first transversal edge (B1) of the cardboard blank (C);

- the first transversal score line (T1) and the second transversal score line (T2) are realised so as to be distant from one another by a distance (I) corresponding to the width of the base of the article to be packed, in this way, in the central sector (SC) of the cardboard blank (C) a first portion (P1) is identified that has dimensions corresponding to the base of the article to be packed, and on which first portion (P1) the article can be rested during the packaging operations;
- the first transversal score line (T1) is realised at a distance from the first transversal edge (B1) of the cardboard blank (C) such that it corresponds to the height (H) of a first lateral flank of the article, and in this way, in the central sector (SC) of the cardboard box (C) a second portion (P2) is identified between the first transversal edge (B1) and the first portion (P1), of dimensions corresponding to a first lateral flank of the article to be packed, and destined to cover the first flank of the article during the packaging operations once folded about the first transversal score line (T1);
- the third transversal score line (T3) is realised so as to be distant from the second transversal score line (T2) by a distance corresponding to the height (H) of a second flank of the article, parallel, and opposite the first flank; in this way, in the central sector (SC) of the cardboard blank (C) a third portion (P3) is defined, adjacent to the first portion (P1) and on the opposite side to the second portion (P2), having dimensions corresponding to the second lateral flank of the article to be packed, and destined to cover the second flank during the packaging operations once folded about the second transversal score line (T2),
- the fourth transversal score line (T4) is realised so as to be distant from the third transversal score line (T3) by a distance corresponding to the width (L*) of the upper face of the article to be packed, in this way, in the central sector (SC) of the cardboard blank (C), a fourth portion (P4) is defined, adjacent to the third portion (P3), having dimensions corresponding to the upper face of the article to be packed, and destined to cover the upper flank once the third portion (P3) has been folded about the second transversal score line (T2) in order to cover the second flank of the article, and the fourth portion (P4) has been folded about the third transversal score line (T3).

The cardboard blank (C) further comprises, again in the central sector (SC), a fifth portion (P5), adjacent to the fourth portion (P4) and hinged thereto by means of the fourth transversal score line (T4), which constitutes a closing/opening tab (AC) that is destined to be glued to the second portion (P2) of the cardboard blank (C), once the second portion (P2) has been folded to envelop the first flank of the article and the third portion (P3) and the fourth portion (P4) have been folded respectively to envelop the second flank of the article and the upper face of the article.

The cardboard blank (C) further comprises, for each of the two lateral sectors (SL1, SL2), four transversal cuts (I1, I2, I3, I4) which extend from the longitudinal edges (BL) of the cardboard blank (C) up to arriving at the two longitudinal score lines (L1, L2), and which are made at the four transversal score lines (T1, T2, T3, T4).

In this way, in the two lateral sectors (SL1, SL2) of the cardboard blank, the cardboard blank (C) comprises:

between the first transversal edge (B1) of the cardboard blank (C) and the transversal cuts (11) made at the first transversal score line (T1): a first reinforcing flap (R1), at a first end of the second portion (P2), foldable on the second portion (P2) about the first longitudinal score line (L1), —and a second reinforcing flap (R2) at a second end of the second portion (P2) and foldable on the second portion (P2) about the second longitudinal score line (L2) so as to at least partly superpose on the first reinforcing flap (R1): the second portion (P2) with the first reinforcing flap (R1) and second reinforcing flap (R2) folded thereon and at least partly superposed, constitutes a first lateral closing wall (C1) which is foldable about the first transversal score line (T1) for covering the first lateral flank of the article to be packed (see FIGS. 1A, 1B);

between the transversal cuts (I2) realised at the second transversal score line (T2) and the third transversal cuts (I3) realised at the third transversal score line (T3): a third reinforcing flap (R3) at a first end of the third portion (P3), foldable on the third portion (P3) about the first longitudinal score line (L1), and a fourth reinforcing flap (R4) at a second end of the third portion (P3) and foldable on the third portion (P3) about the second longitudinal score line (L2) so as to at least partly superpose on the third reinforcing flap (R3): the third portion (P3) with the third reinforcing flap (R3) and fourth reinforcing flap (R4) folded thereon and at least partly superposed, constitutes a second lateral closing wall (C2) which is foldable about the second transversal score line (T2) for covering the second lateral flank, opposite the first flank, of the article to be packed (see FIGS. 1B, 1C);

between the first transversal cuts (I1) realised at the first transversal score line (T1) and the transversal cuts (I2) realised at the second transversal score line (T2), a first lateral enveloping flap (A1) at a first end of the first portion (P1), foldable about the first longitudinal score line (L1) for covering and enveloping a third lateral flank of the article to be packed, and a second lateral enveloping flap (A2), at a second end of the first portion (P1), foldable about the second longitudinal score line (L2) for covering and enveloping the fourth flank, opposite the third flank, of the article to be packed (see FIGS. 1A, 1B);

between the transversal cuts (I3) made at the third transversal score line (T3) and the transversal cuts (14) made at the fourth transversal score line (T4), a fifth reinforcing flap (R5) at a first end of the fourth portion (P4), foldable on the fourth portion (P4) about the first longitudinal score line (L1), and a sixth reinforcing flap (R6) at a second end of the fourth portion (P4) and foldable on the fourth portion (P4) about the second longitudinal score line (L2) so as to at least partly superpose on the fifth reinforcing flap (R5): the fourth portion (P4) with the fifth (R5) and sixth (R6) reinforcing flap folded thereon and at least partly superposed, constitutes an upper closing wall (PS) which is foldable about the third transversal score line (T3), once the second lateral closing wall (C2) has been folded about the second transversal score line (T2) for covering the second lateral flank, for covering the upper face of the article to be packed (see FIGS. 1A, 1F).

The first lateral enveloping flap (A1) comprises a pair of longitudinal folding lines (a, b) parallel and realised at a distance such that on the first flap (A1), between the two folding lines (a, b), a third lateral closing wall (C3) is identified, having a height corresponding to the height of a third lateral flank of the article to be packed, and also a first folding tab (a1), between the third lateral closing wall (C3) and the first longitudinal score line (L1), and a second folding tab (a2), between the third lateral closing wall (C3) and the longitudinal edge (BL) of the cardboard blank (C) are identified.

The first folding tab (a1) is destined to superpose on a part of the first portion (P1) once it has been rotated with respect to the first longitudinal score line (L1), so as to form a reinforcing edge, while the second folding tab (a2) is destined, once the third lateral closing wall (C3) has been folded with respect to the first folding tab (a1) for covering the third flank of the article, to be folded with respect to the third lateral closing wall (C3) for covering a portion of the upper face of the article, before the face is covered by the upper closing wall (PS).

Correspondingly, the second lateral enveloping flap (A2) comprises a pair of longitudinal folding lines (c, d) parallel and realised at a distance such that on the second flap (A2) a fourth lateral closing wall (04) is identified, having a height corresponding to the height of a fourth lateral flank of the article to be packed, opposite the third flank, and also a third folding tab (a3), between the fourth lateral closing wall (C4) and the second longitudinal score line (L2), and a fourth folding tab (a4), between the fourth lateral closing wall (C4) and the second longitudinal edge (BL) of the cardboard blank (C) are identified.

The third folding tab (a3) is destined to superpose on a part of the first portion (P1) once it has been rotated with respect to the second longitudinal score line (L2), so as to form a reinforcing edge, while the fourth folding tab (a4) is destined, once the fourth lateral closing wall (C4) has been folded with respect to the third folding tab (a3) for covering the fourth flank of the article, to be folded with respect to the fourth lateral closing wall (C4) for covering a portion of the upper face of the article, before the face is covered by the upper closing wall (PS) (see FIGS. 1C-1F).

SUMMARY OF THE INVENTION

The present invention has the aim of providing a folding station able to rapidly and effectively carry out and realise the folding of the reinforcing flaps, present in the two lateral sectors of cardboard blank, on the respective portions of the central sector of the cardboard blank, and the folding of the first folding tab and the third folding tab of the two lateral enveloping flaps, on the first portion present in the central sector of the cardboard blank.

More precisely, the present invention has the aim of providing a folding station which receives in inlet a cardboard blank (C) such as the one described in the foregoing and illustrated in FIG. 1 and realising:

the rotation of the first reinforcing flap (R1), present in the first lateral sector (SL1) of the cardboard blank (C), about the first longitudinal score line (L1), and the rotation of the second reinforcing flap (R2), present in the second lateral sector (SL2) of the cardboard blank (C), about the second longitudinal score line (L2), for folding the flaps (R1, R2) about the second portion (P2)

of the central sector (SC) of the cardboard blank (C), so that the two reinforcing flaps are also at least partly superposed on one another, so as to obtain a reinforced wall, which will constitute a reinforced first lateral closing wall (C1) of a cardboard box which will be obtained from the cardboard blank;

the rotation of the third reinforcing flap (R3), present in the first lateral sector (SL1) of the cardboard blank (C), about the first longitudinal score line (L1), and the rotation of the fourth reinforcing flap (R4), present in the second lateral sector (SL2) of the cardboard blank (C), about the second longitudinal score line (L2), for folding the flaps (R1, R2) about the third portion (P3) of the central sector (SC) of the cardboard blank (C), so that the two reinforcing flaps are also at least partly superposed on one another, so as to form a reinforced wall, which will constitute a reinforced second lateral closing wall (C2) of a cardboard box which will be obtained from the cardboard blank;

the rotation of the fifth reinforcing flap (R5), present in the first lateral sector (SL1) of the cardboard blank (C), about the first longitudinal score line (L1), and the rotation of the sixth reinforcing flap (R6), present in the second lateral sector (SL2) of the cardboard blank (C), about the second longitudinal score line (L2), for folding the flaps (R1, R2) about the fourth portion (P4) of the central sector (SC) of the cardboard blank (C), so that the two reinforcing flaps are also at least partly superposed on one another, so as to form a reinforced wall, which will constitute a reinforced upper closing wall (PS) of a cardboard box which will be obtained from the cardboard blank;

the rotation of the first folding tab (a1) of the first lateral enveloping flap (A1), present in the first lateral sector (SL1) of the cardboard blank (C), about the first longitudinal score line (L1), so as to fold and arrange the first folding tab (a1) on a part of the first portion (P1) of the central sector (SC) of the cardboard blank (C), for forming a first reinforcing edge, and the rotation of the third folding tab (a3) of the second lateral enveloping flap (A2), present in the second lateral sector (SL2) of the cardboard blank (C), about the second longitudinal score line (L2), so as to fold and arrange the third folding tab (a3) on a part of the first portion (P1) of the central sector (SC), for forming a second reinforcing edge.

The cited aim is obtained with a folding station according to claim 1.

The present invention also has the aim of providing a machine for obtaining a cardboard blank such as the one described in the preamble and illustrated in FIG. 1, starting from a continuous strip of cardboard stored in a fanfold, and having dimensions corresponding to the effective dimensions of the base, the lateral flanks and the upper wall of the article to be packed, and for carrying out all the operations necessary for carrying out the packaging of an article internally of a box obtained from the cardboard blank.

The objective of the invention is also to provide a machine able to carry out all the operations necessary for completing the packaging of an article internally of a cardboard box, very rapidly and efficiently, with the aim of guaranteeing high productivity in terms of numbers of articles packaged per hour, up to even 1000 articles packaged per hour.

This aim is obtained by a machine for packing an article internally of a cardboard box obtained from a cardboard blank as described in the preamble, according to claim 13, and comprising the folding station of claim 1.

BRIEF DESCRIPTION OF THE DRAWINGS

The characteristics of a preferred embodiment of a folding station for folding a cardboard blank, and a machine for packaging an article internally of a cardboard box obtained from the cardboard blank, of the present invention, will be described in the following with reference to the appended tables of drawings, in which.

Figure 1:
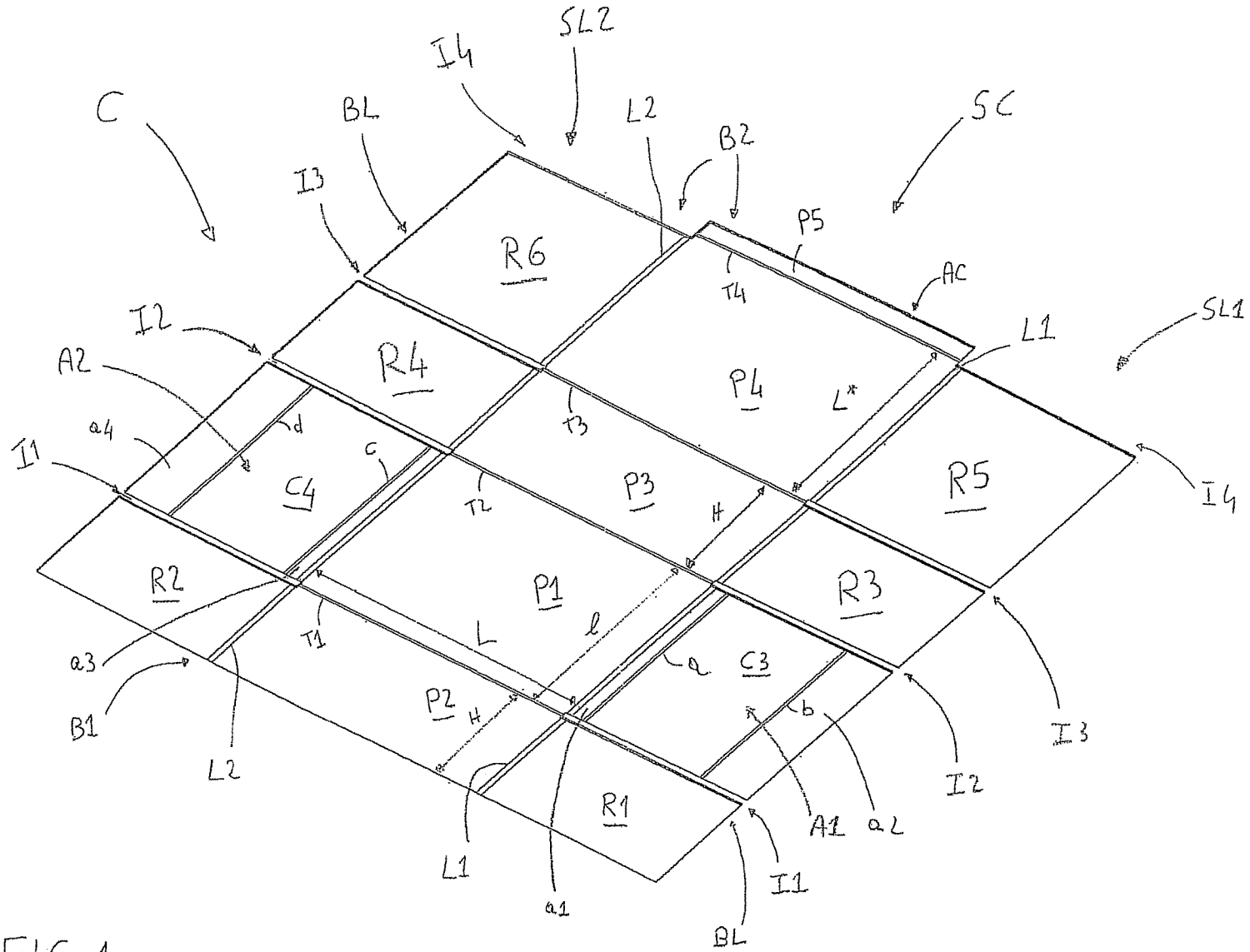
FIG. 1, mentioned in the preamble to the present description, in a perspective view, illustrates the cardboard blank for packaging designed by the Applicant and object of the above-cited Italian patent application, which cardboard blank is supplied to the inlet of the folding station of the invention, and in which the machine of the invention, comprising the folding station, is able to process in the successive work stations so as to pack an article in a cardboard box obtained from the cardboard blank.
Figure 2A:
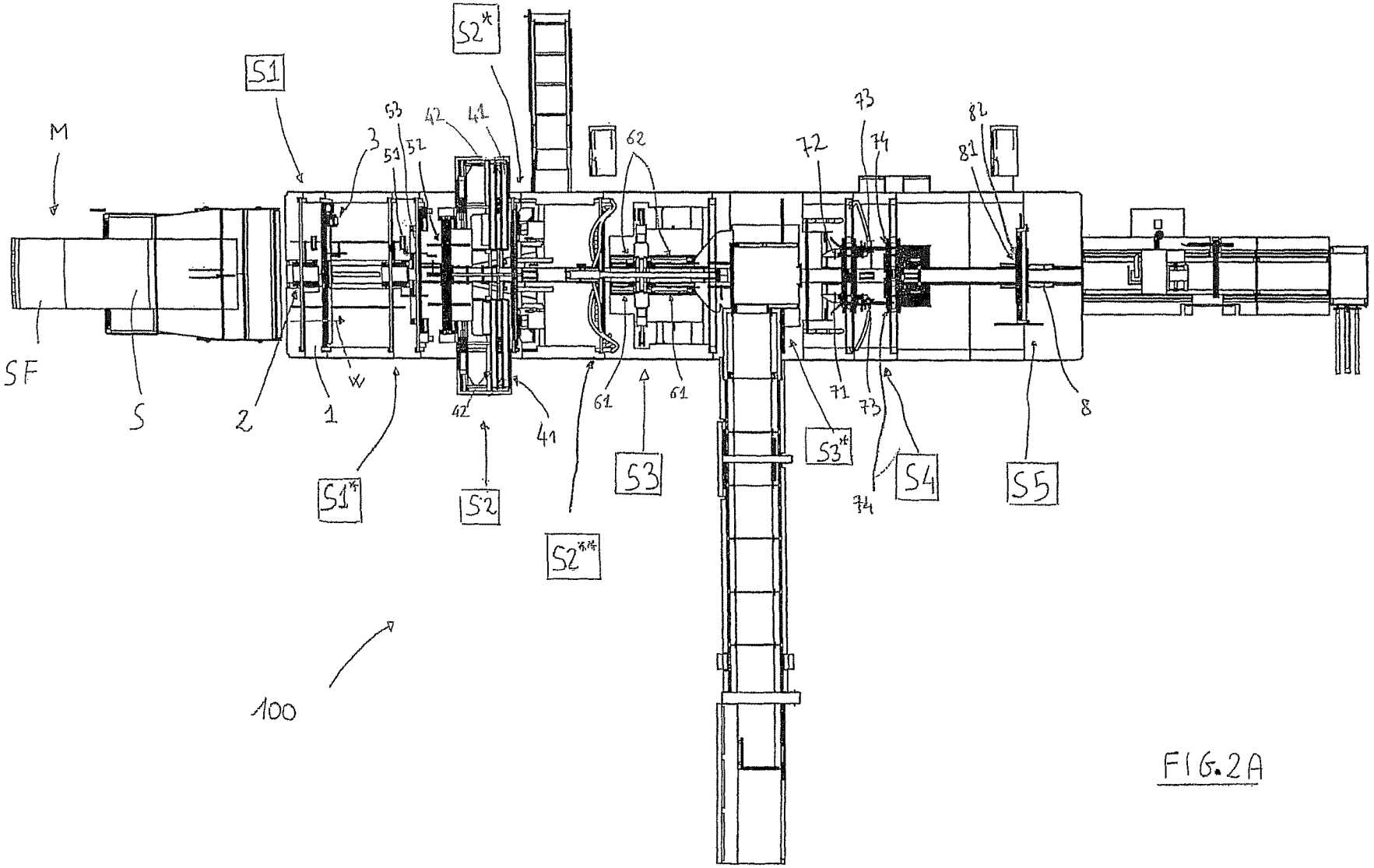
Figure 2B:
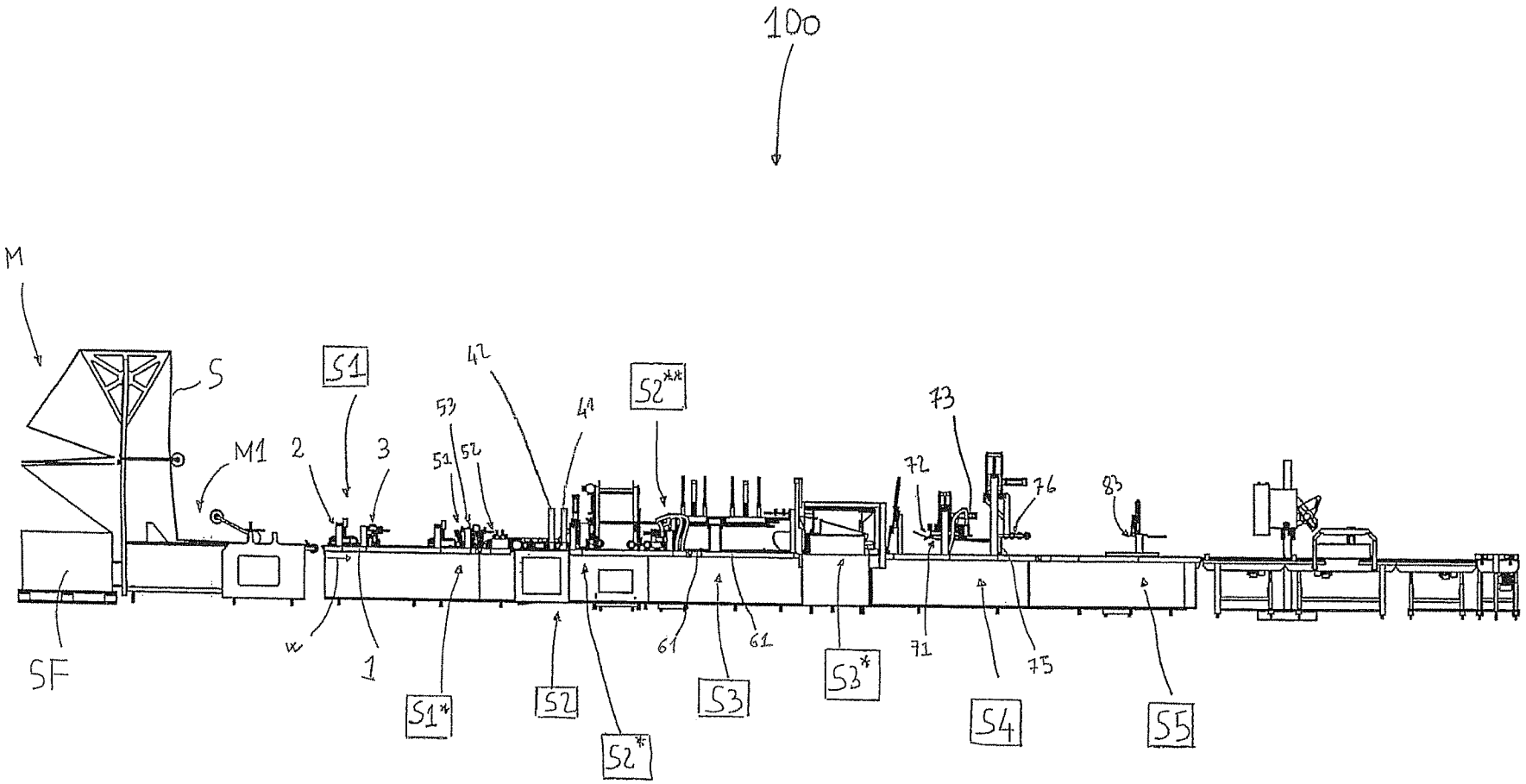
Figure 2C:
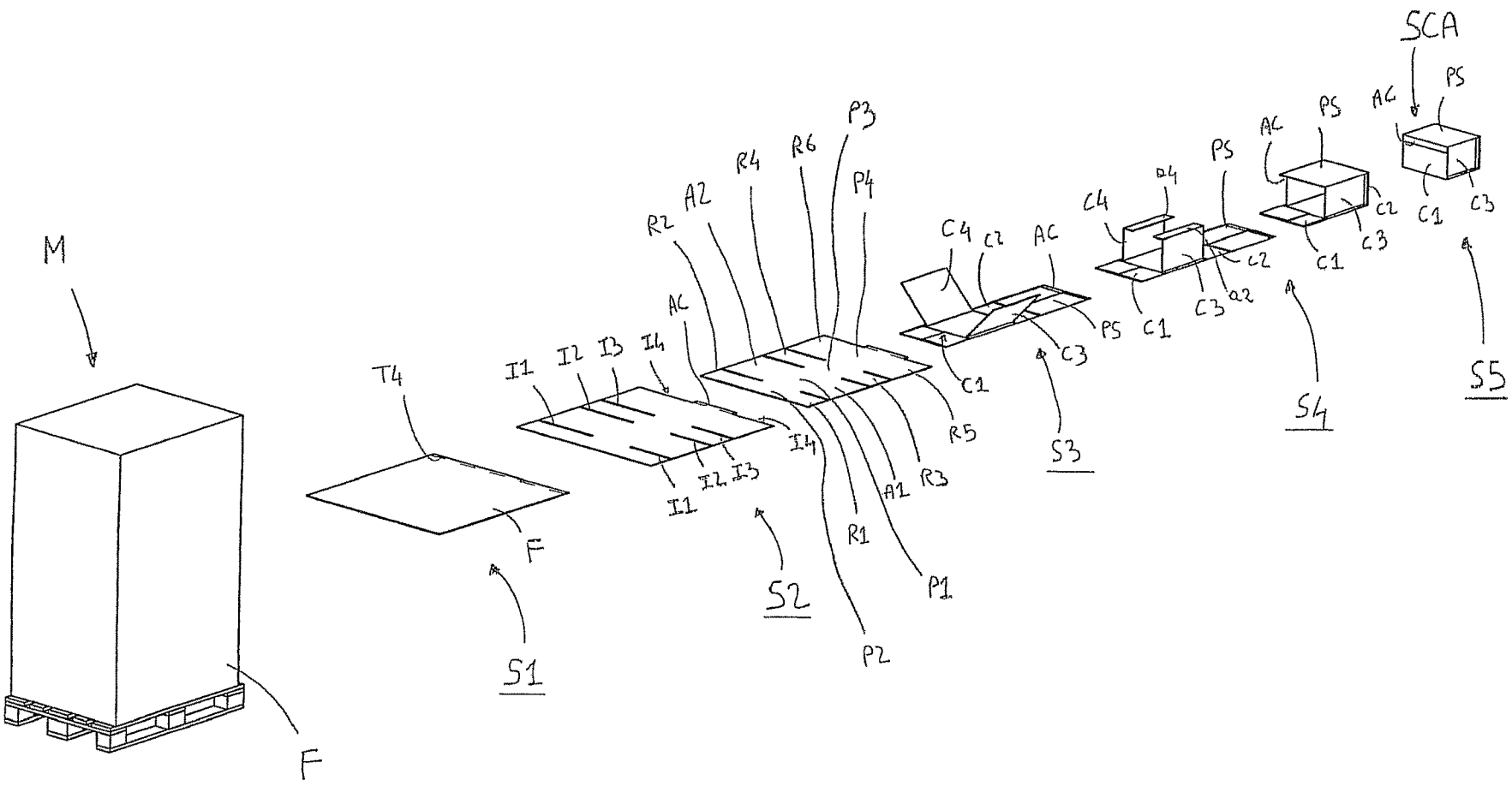
Figure 2D:
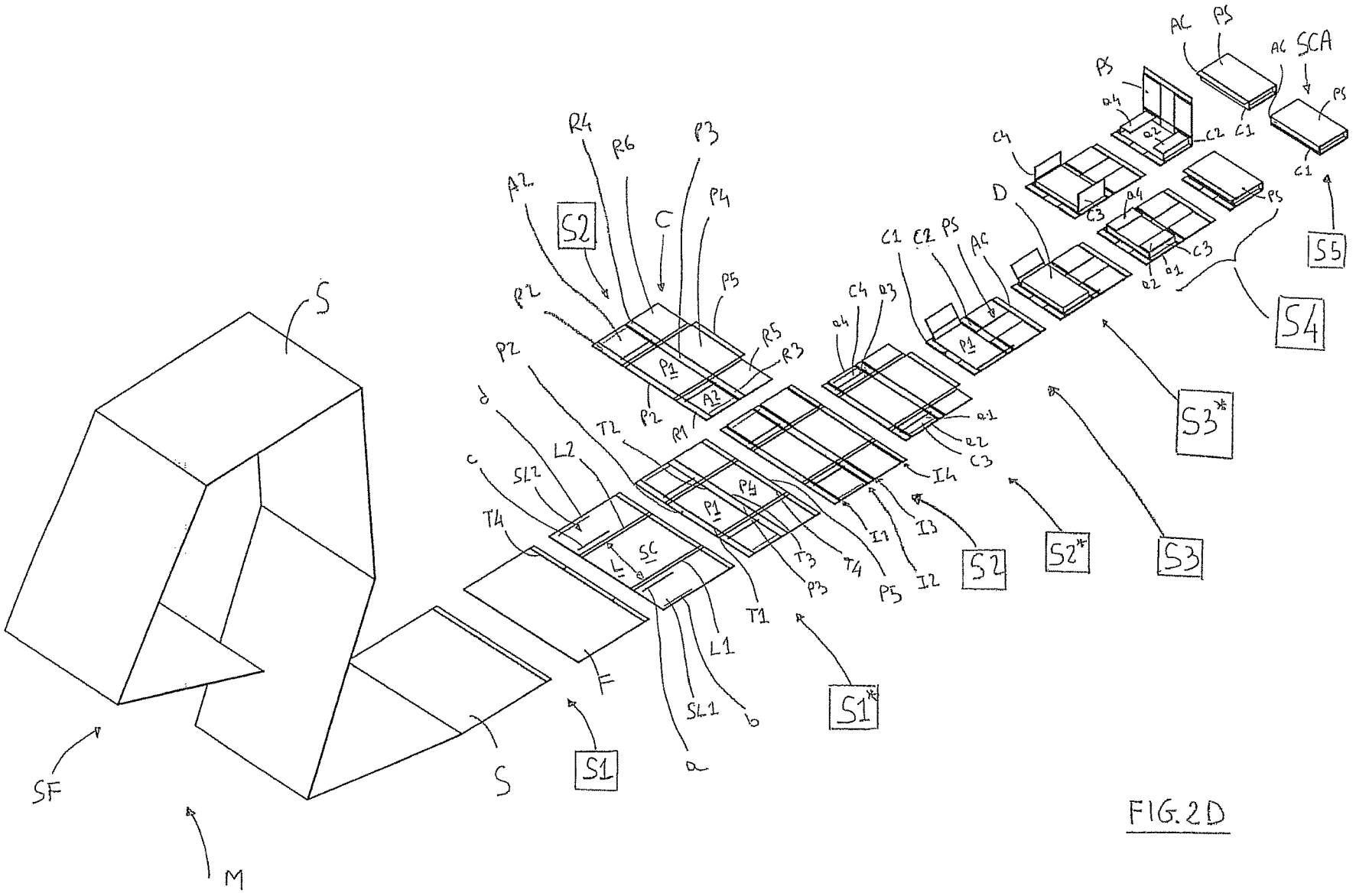
Figure 3A:
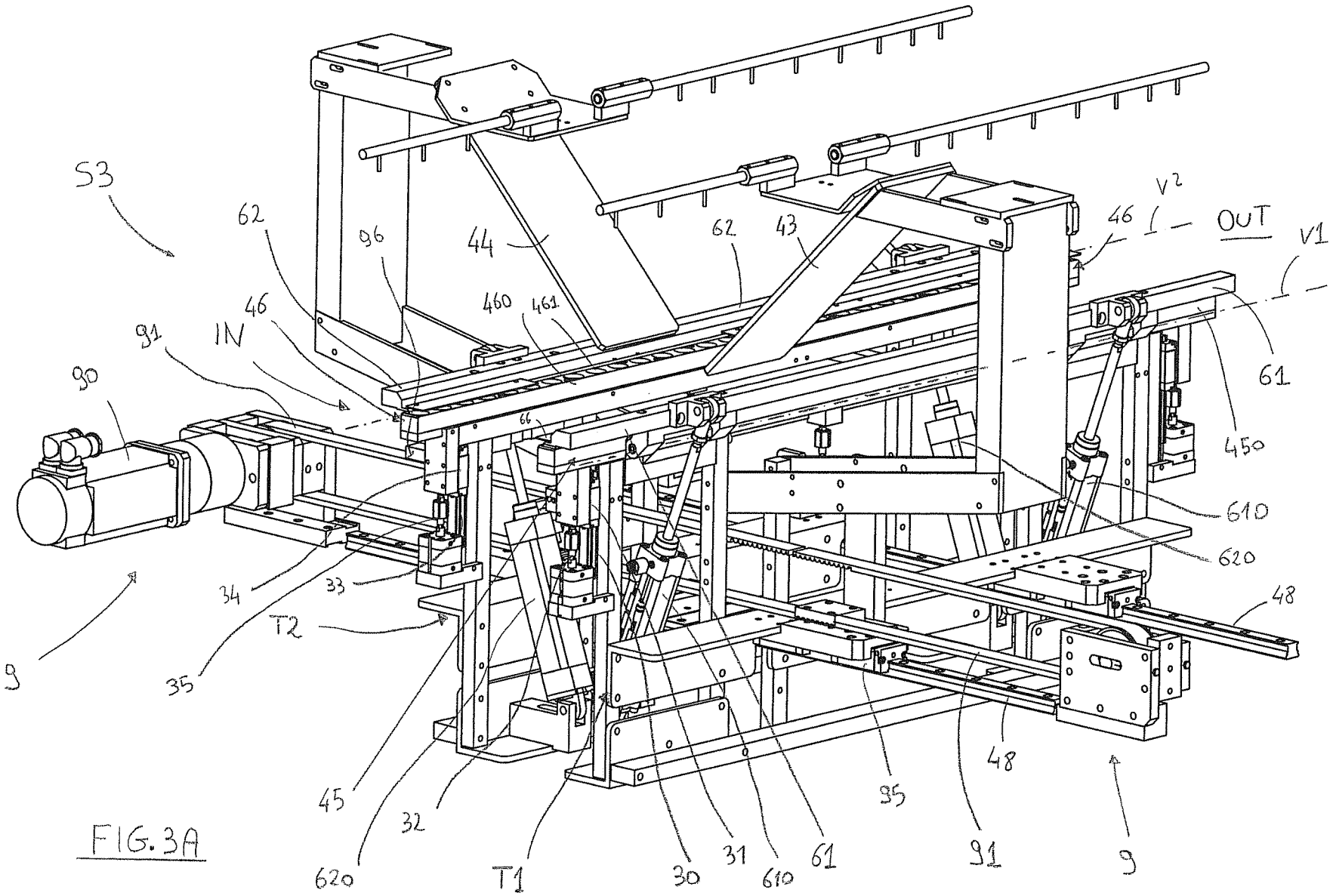
Figure 3B:
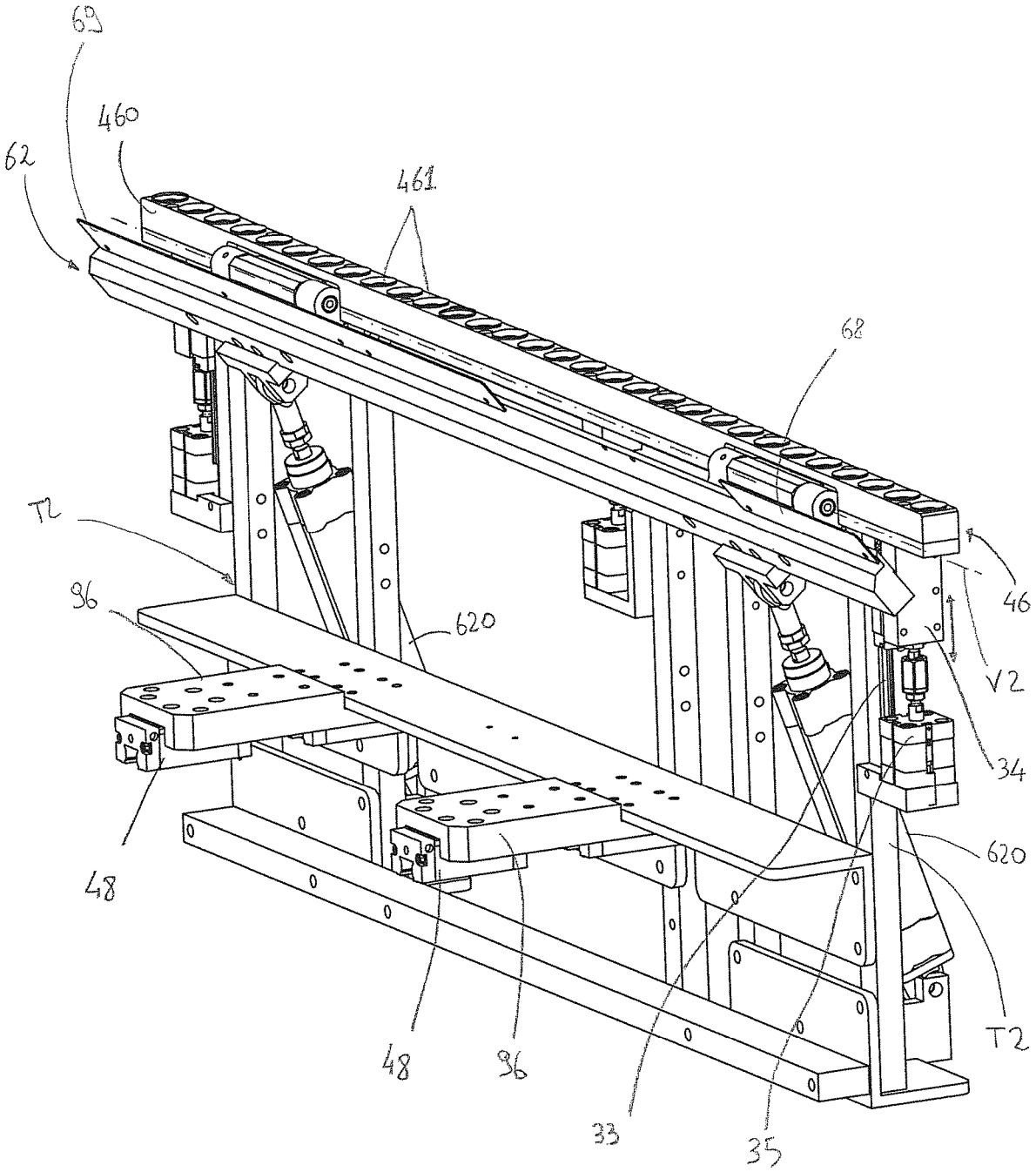
Figure 3C:
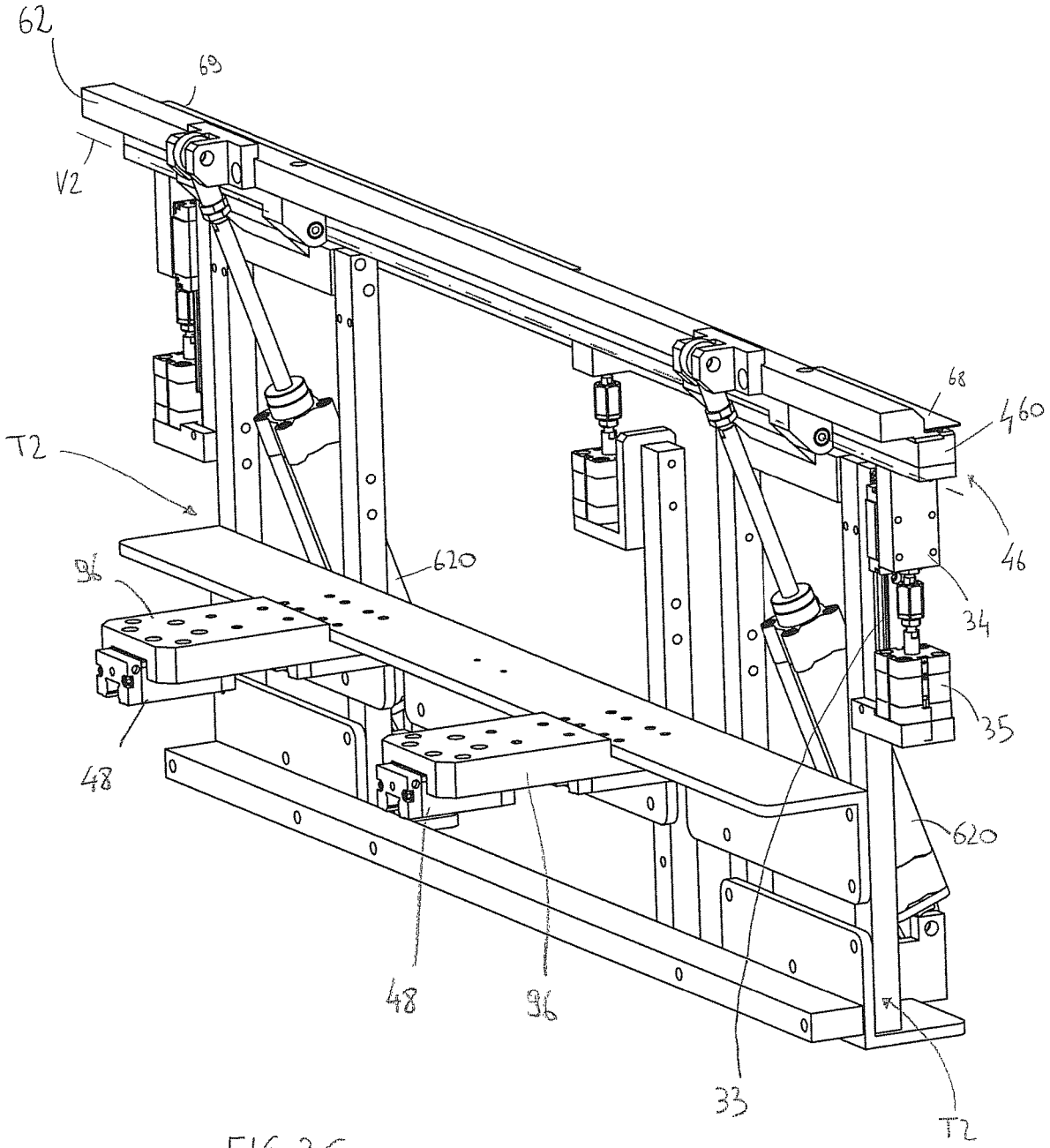

FIGS. from 1A to 1F illustrate, according to respective perspective views, possible folding steps of the cardboard blank of FIG. 1, described in the above-mentioned patent application filed by the Applicant, so as to enable packaging an article and obtaining a closed cardboard box with the article inside;

FIG. 2A illustrates, in a schematic view from above, the overall layout of a machine for packing an article internally of a cardboard box obtained from a cardboard sheet of the present invention;

FIG. 2B illustrates the machine of FIG. 2 in a lateral view;

FIG. 2C schematically illustrates, in a succession of images, example embodiments of some main work operations that the packaging machine of the invention carries out starting from a cardboard sheet cut from a continuous strip of cardboard contained in a fanfold, for obtaining first the cardboard blank illustrated in FIG. 1, and then folding the cardboard blank about an article and obtaining a closed cardboard box with the article packaged and closed inside it;

FIG. 2D very schematically illustrates, with a succession of images in perspective view, the operating sequence of the machine of the present invention;

FIG. 3A illustrates, in a schematic perspective view, the folding station of the present invention designed to receive in inlet a cardboard blank such as the one described in the foregoing and illustrated in FIG. 1, and for realising the folding of the reinforcing flaps present in the two lateral sectors of the cardboard blank on the relative portions of the central sector of the cardboard blank, and the folding of the first and third folding tab of the two lateral enveloping flaps present in the two lateral sectors of the cardboard blank on parts of the first portion of the central sector of the cardboard blank, with some parts removed so as to highlight other significant parts and components of the folding station;

FIG. 3B illustrates, in a schematic perspective view, some significant components of the folding station of the present invention in a relative first possible configuration thereof;

FIG. 3C illustrates, again according to the same schematic perspective view, the components of the folding station of FIG. 3B in a second possible configuration in which they have realised the folding of the reinforcing flaps on the relative portions of the central sector of the cardboard blank and the folding of the first and third folding tabs on the respective parts of the first portion of the central sector of the cardboard blank;

FIGS. from 4A to 4G illustrate, in respective perspective views, the operating sequence of the folding station of the invention for folding the first and of the second reinforcing flap on the second portion of the central sector of the cardboard blank, for folding the third and fourth reinforcing flap on the third portion of the central sector of the cardboard blank, for folding the fifth and sixth reinforcing flap on the fourth portion of the central sector of the cardboard blank, and for the folding of the first and third folding tab on the parts of the first portion of the central sector of the cardboard blank.

DESCRIPTION OF THE PREFERRED EMBODIMENTS

With reference to the appended figures of the drawings, (S3) denotes the folding station for folding a cardboard blank of the present invention, while reference numeral (100) denotes the machine for packaging an article internally of a cardboard box obtained from the cardboard sheet in its entirety, and comprising, among the various work stations, the folding station (S3).

The folding station (S3) of the present invention is designed, as mentioned in the foregoing, to realise the folding of the reinforcing flaps, present in the two lateral sectors of the cardboard blank on the corresponding portions of the central sector of the cardboard blank and the folding of the first folding tab and the third folding tab of the two lateral enveloping flaps present in the two lateral sectors of the cardboard blank, on the parts of the first portion present in the central sector.

In detail, the cutting station (S3) comprises a inlet (IN), for receiving a cardboard sheet (F), an outlet (OUT), for providing in outlet a cardboard blank, partly folded as described above, and a conveyor (4), for example a conveyor belt, which extends from the inlet (IN) to the outlet (OUT) for conveying the cardboard sheet (F) from the inlet (IN) to the outlet (OUT) according to an advancement direction (V).

The folding station (S3) is able to receive at the inlet (IN) thereof a cardboard blank (C) which is fed to the inlet (IN) in an orientation such as to present the relative two transversal edges (B1, B2) arranged transversally and perpendicularly to the conveyor (4), and to the advancement direction (V) of the conveyor (4), and the relative longitudinal edges (BL) parallel to the conveyor (4), and therefore to the advancement direction (V) of the conveyor (4).

The folding station (S3) receives at the inlet (IN) thereof a cardboard blank (C) (see FIG. 1 and see FIG. 4A) which comprises two longitudinal score lines (L1, L2), parallel to the longitudinal edges (BL) of the cardboard blank (C) and to the advancement direction (V) of the conveyor (4) and four transversal score lines (T1, T2, T3, T4), parallel to the transversal edges (B1, B2) of the cardboard blank (C), and transversal and perpendicular to the advancement direction (V).

The two longitudinal score lines (L1; L2) are parallel to one another, from a first transversal edge (B1) to a second transversal edge (B2) of the cardboard blank (C), and at a reciprocal distance from one another corresponding to the length (L) of the base of the article to be packed inside a cardboard box which is obtained from the cardboard blank (C), The four transversal score lines (T1, T2, T3, T4)) are parallel to one another, from one longitudinal edge (BL) to the other longitudinal edge (BL) of the cardboard blank (C), and are distanced from one another as a function of the effective dimensions of the article to be packed, in particular on the basis of the width of the base of the article, the width (L*) of the upper face of the article and the height (H) of two opposite flanks of the article.

In particular, starting from a first transversal edge (B1) of the cardboard blank (C), being the upstream edge relative to advancement direction (V) of the conveyor (4):

- a first transversal score line (T1) at a distance from the first transversal edge (B1) of the cardboard blank (C) corresponding to the height (H) of a first lateral flank of the article,
- a second transversal score line (T2) is at a distance from the first score line (T1) corresponding to the width (I) of the base of the article to be packed;
- a third transversal score line (T3) at a distance from the second transversal score line (T2) corresponding to a height (H) of a second flank of the article, parallel and opposite the first flank;
- a fourth transversal score line (T4) at a distance from the third transversal score line (T3) corresponding to the width (L*) of the upper face of the article to be packed.

Therefore the cardboard blank (C) that the cutting station (S3) receives at the inlet (IN) thereof will have a central sector (SC), between the two longitudinal score lines (L1, L2), and two lateral sectors (SL1, SL2) externally of the two longitudinal score lines (L1, L2).

In the central sector (SC), the cardboard blank (C) comprises five portions (P1, P2; P3, P4, P5) defined by the four transversal score lines (T1, T2; T3, T4), in particular (see FIG. 1 and FIG. 4A once more):

- a first portion (P1), between the first transversal score line (T1) and the second transversal score line (T2);

a second portion (P2), between a first transversal edge (B1) of the cardboard blank (C) and the first transversal score line (T1), adjacent to the first portion (P1) and hinged thereto by means of the first transversal score line (T1);

- a third portion (P3), between the second transversal score line (T2) and the third transversal score line (T3), adjacent to the first portion (P1) and hinged thereto by means of the second transversal score line (T2);
- a fourth portion (P4), between the third transversal score line (T3) and the fourth transversal score line (T4), adjacent to the third portion (P3) and hinged thereto by means of the third transversal score line (T3);
- a fifth portion (P5) between the fourth transversal score line (T4) and the second transversal edge (B2) of the cardboard blank (C).

Further, the cardboard blank (C) received at the inlet (IN) of the folding station (S3) of the invention comprises, for each of the two lateral sectors (SL1, SL2), four cuts (11, 12, 13, 14) which extend from the longitudinal edges (BL) of the cardboard blank (C) up to arriving at the two longitudinal score lines (L1, L2), and which are made at the four transversal score lines (T1, T2, T3, T4).

Therefore the cardboard blank received at the inlet (IN) of the folding station (S3) further comprises, in the two lateral sectors (SL1, SL2):

- between the first transversal edge (B1) of the cardboard blank (C) and the transversal cuts (11) made at the first transversal score line (T1): a first reinforcing flap (R1), hinged, by the first longitudinal score line (L1), to a first end of the second portion (P2), and a second reinforcing flap (R2) hinged, by the second longitudinal score line (L2), to a second end of the second portion (P2);
- between the transversal cuts (12) realised at the second transversal score line (T2) and the third transversal cuts (13) realised at the third transversal score line (T3): a third reinforcing flap (R3) hinged by the first longitudinal score line (L1) to a first end of the third portion (P3), and a fourth reinforcing flap (R4) hinged, at the second longitudinal score line (L2), to a second end of the third portion (P3);

between the transversal cuts (11) realised at the first transversal score line (T1) and the transversal cuts (12) realised at the second transversal score line (T2): a first lateral enveloping flap (A1) hinged, via the first longitudinal score line (L1), to a first end of the second portion (P1), and a second lateral enveloping flap (A2) hinged, via the second longitudinal score line (L2), to a second end of the first portion (P1);

between the transversal cuts (I3) realised at the third transversal score line (T3) and the transversal cuts (I4) realised at the fourth transversal score line (T4): a fifth reinforcing flap (R5) hinged, via the first longitudinal score line (L1), to a first end of the fourth portion (P4), and a sixth reinforcing flap (R6) hinged, via the second longitudinal score line (L2), to a second end of the fourth portion (P4).

Lastly, the cardboard blank (C) comprises:

in the first lateral enveloping flap (A1), a pair of longitudinal folding lines (a, b) parallel and realised at a distance such that on the first lateral enveloping flap (A1), between the two folding lines (a, b), a central part (C3) is identified, having a height corresponding to the height of a third lateral flank of the article to be packed, and also a first folding tab (a1), hinged to the first longitudinal score line (L1), between the third central part (C3) and the first score line (L1), and a second folding tab (a2), between the central part (C3) and the longitudinal edge (BL) of the cardboard blank (C) are identified.

and in the second lateral enveloping flap (A2), a pair of longitudinal folding lines (c, d) parallel and realised at a distance such that a central part (C4) is identified on the second lateral enveloping flap (A2), having a height corresponding to the height of a fourth lateral flank of the article to be packed, opposite the third flank, and a third folding tab (a3), hinged to the second longitudinal score line (L2), between the central part (C4) and the second score line (L2), and a fourth folding tab (a4), between the central part (C4) and the second longitudinal edge (BL) of the cardboard blank (C), are also defined.

Figure 4A:
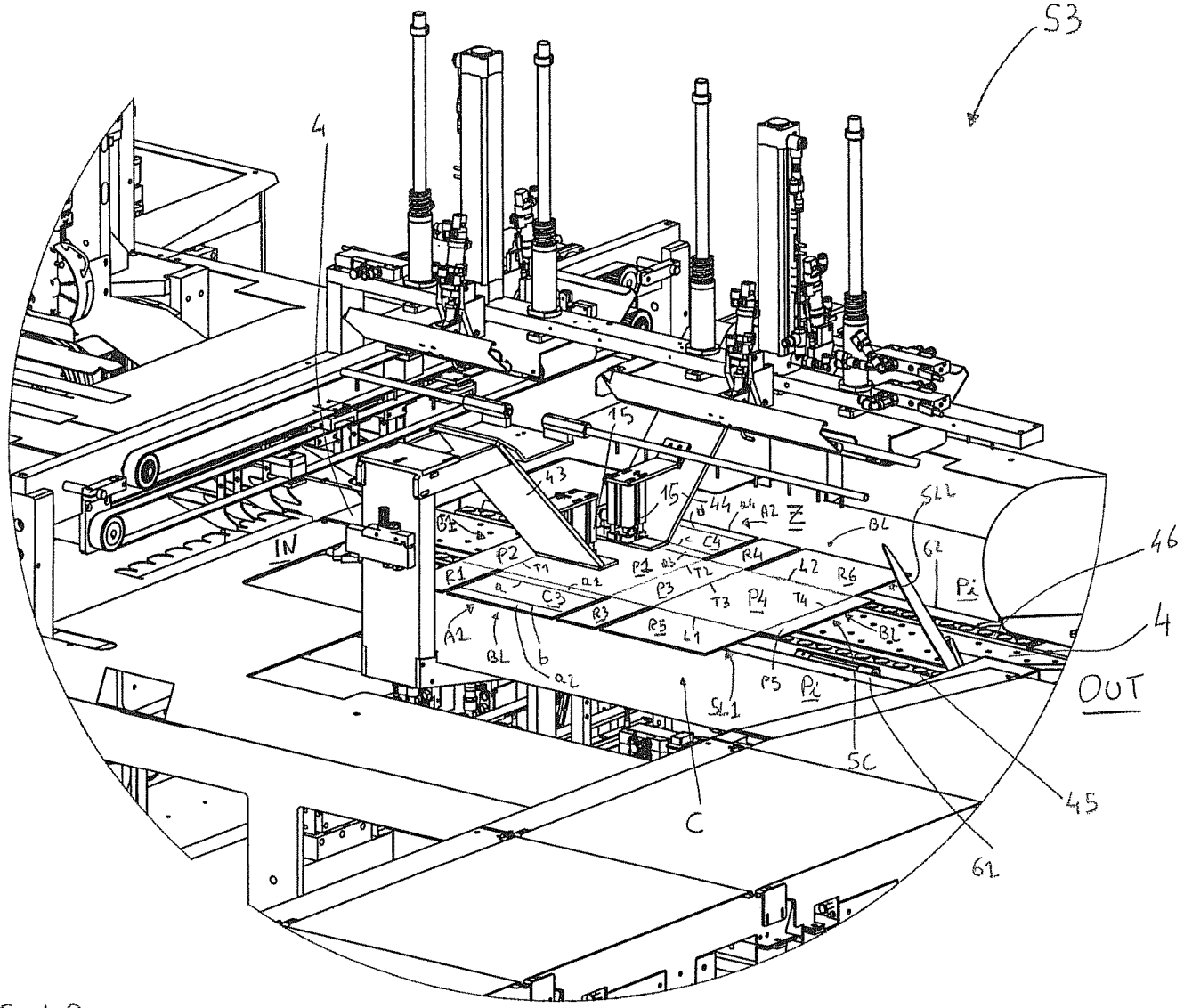

The conveyor (4) is predisposed so that the cardboard blank (C) is arranged thereon resting with at least a part of the central sector (SC) thereof and with the two lateral sectors (SL1, SL2) which project laterally beyond the two sides of the conveyor (4) (see FIG. 4A).

The folding station (S3) of the present invention comprises, flanked to a first side of the conveyor (4), a first folding bar (61), and, flanked to a second side of the conveyor (4), a second folding bar (62).

The first folding bar (61) is arranged parallel to the conveyor (4) and is predisposed so as to be swivellable and rotatable according to a first rotation axis (V1) parallel to the conveyor (4), i.e. to the advancement direction (V) of the conveyor (4); in the same way, the second folding bar (62) is arranged parallel to the conveyor (4) and is predisposed so as to be swivellable and rotatable according to a second rotation axis (V2) parallel to the conveyor (4), i.e. to the advancement direction (V) of the conveyor (4).

The conveyor (4) can be step-activated so as to advance the cardboard blank (C) from the inlet (IN) up to a position (Z) in which it is between the two folding bars (61, 62), and then the conveyor (4) is halted to stop the cardboard blank (C) in this position.

The first folding bar (61) and the second folding bar (62) are activatable in sequence so as to be rotated about the relative rotation axes (V1, V2) so as to abut the reinforcing flaps, and the first folding tab (a1) and the third folding tab (a2) of the two enveloping flaps, present in the two lateral sectors (SL1, SL2) of the cardboard blank (C), so as to rotate them with respect to the first longitudinal score line (L1) and second longitudinal score line (L2) in order to fold them up to arranged them above the respective portions of the central sector (SC) of the cardboard blank (C).

In detail, the first folding bar (61) is rotatable about the first rotation axis (V1) in order to abut the first reinforcing flap (R1), the first folding tab (a1) of the first enveloping flap (A1), the third reinforcing flap (R3) and the fifth reinforcing flap (R5) present in the first lateral sector (SL1) of the cardboard blank (C), and to rotate them about the first longitudinal score line (L1) so as to fold and arrange them respectively: the first reinforcing flap (R1) above the second portion (P2) of the central sector (SC); the first folding tab (a1) above a part of the first portion (P1) of the central sector (SC); the third reinforcing flap (R3) above the third portion (P3) of the central sector (SC) and the fifth reinforcing flap (R5) above the fourth portion (P4) of the central sector (SC).

In turn, the second folding bar (62) is rotatable about the second rotation axis (V2) in order to abut the second reinforcing flap (R2), the third folding tab (a3) of the second enveloping flap (A2), the fourth reinforcing flap (R4) and the sixth reinforcing flap (R6) present in the second lateral sector (SL2) of the cardboard blank (C), and to rotate them about the second longitudinal score line (L2) so as to fold and arrange them respectively: the second reinforcing flap (R2) above the second portion (P2) of the central sector (SC); the third folding tab (a3) above a part of the first portion (P1) of the central sector (SC); the fourth reinforcing flap (R4) above the third portion (P3) of the central sector (SC) and the sixth reinforcing flap (R6) above the fourth portion (P4) of the central sector (SC), In this way:

the first reinforcing flap (R1) and the second reinforcing flap (R2) are folded and positioned above the second portion (R2) of the central sector (SC), at least partially overlapping one another, forming a reinforced wall, which will constitute a first lateral closing wall (C1) of a cardboard box, for enveloping of a first lateral flank of an article which is to be packed internally of the cardboard box;

the third reinforcing flap (R3) and the fourth reinforcing flap (R4) are folded and positioned above the third portion (P3) of the central sector (SC), at least partially overlapping one another, thus forming a reinforced wall, which will constitute a second lateral closing wall (C2) of the cardboard box, for enveloping of a second flank, opposite the first, of the article to be packed internally of the cardboard box;

the fifth reinforcing flap (R5) and the sixth reinforcing flap (R6) are folded and positioned above the fourth portion (P4) of the central sector (SC), at least partially overlapping one another, forming a reinforced wall, which will constitute an upper closing wall (PS) of the cardboard box, for enveloping of an upper wall of the article to be packed internally of the cardboard box;

the first folding tab (a1) and the third folding tab (a3) are folded and positioned above the relative parts of the first portion (P1) of the central sector (SC) of the cardboard blank, forming reinforcing edges at the sides of the first portion (P1) which is destined to restingly receive the base of the article to be packed and thus constitute the base wall of the cardboard box.

In the preferred embodiment illustrated in the appended figures of the drawings, see the sequence of figures from 4A to 4G, the second bar (62) is the first to be activated, while the first bar (61) is activated immediately after, as soon as the second bar (62) has completed its folding operation, so as not to incur impacts between the reinforcing flaps of the two lateral sectors during folding thereof.

In a further possible embodiment, not illustrated, the opposite situation can occur, i.e. with the first bar (61) being activated in advance with respect to the second bar (62).

The activating of the two folding bars is almost simultaneous, and therefore the folding operations are substantially contemporaneous.

Further special aspects of the folding station (S3) of the present invention consist in the fact that the first folding bar (61) and the second folding bar (62) are arranged at the two sides of the conveyor (4) so as to be mutually neared or distanced to or from one another, so that they can be neared to or distanced from the conveyor.

In particular, the two folding bars (61, 62) are translatable and movable, in mutual nearing or distancing, being kept parallel to one another according to a direction that is transversal and perpendicular to the conveyor (4).

This peculiarity enables, before being activated in rotation about the relative rotation axes (V1, V2) and performing the folding operations thereof, positioning the two folding bars (61, 62) with respect to the conveyor (4) on the basis of the effective dimensions of the cardboard blank (C) which correspond to the effective dimensions of the article that is to be packed internally thereof.

Therefore, on the basis of the effective dimensions of the central sector (SC), which is resting on the conveyor (4) at least by a central part thereof, and the effective dimensions (width) of the two lateral sectors (SL1, SL2) which project from the two sides of the conveyor (4), the two folding bars (61, 62) are mutually neared or distanced so as to be positioned in a position with respect to the two lateral sectors (SL1, SL2) of the cardboard blank in such a way that when activated in rotation about the relative rotation axes, they can abut and rotate the reinforcing flaps and the folding tabs present in these two lateral sectors about the first and second longitudinal score line so as to fold them and arranged them above the relative portions of the central sector.

Lastly, a further special aspect of the folding station (S3) of the present invention consists in the fact that it comprises abutting elements (43, 44) which are located above the conveyor (4) in a position that is such as to be abutted, during the rotation and folding of the first folding tab (a1) and of the third folding tab (a3) above the first portion (P1) of the central sector (SC) of the cardboard blank (C), at the central part (C3) of the first enveloping flap (A1) and at the central part (C4) of the second enveloping flap (A2) in such a way as to constrain them and maintain them in a raised position and raised with respect to the relative longitudinal folding line (a, c) with which they are hinged respectively to the first folding tab (a1) and the third folding tab (a3), so as to identify, respectively, a third lateral closing wall (C3) and a fourth lateral closing wall (C4) of the cardboard box which are destined to envelop a third and a fourth flank of the article to be packed in the cardboard box.

For example, the abutting elements (43, 44) are preferably constituted by plates arranged mutually inclined above the conveyor (4).

Once these folding operations have been carried out, the two folding bars (61, 62) are rotated in opposite directions about the relative rotation axes (V1, V2) so as to free the cardboard blank (C), and the conveyor (4) is newly activated to convey the cardboard blank (C), partially folded at the outlet (OUT) of the folding station (S3).

It is clear that the folding station (S3) of the invention can carry out the folding operations rapidly and efficiently, as in a single operation all the reinforcing flaps and the folding tabs present in each of the two lateral sectors of the cardboard blank are contemporaneously folded above the respective portions of the central sector of the cardboard blank; this is due to the presence of the two folding bars at the two sides of the conveyor, which are activatable in succession one following the other about a rotation axis parallel to the conveyor.

Further, the folding station (S3) is able to adapt to all the possible dimensions of the cardboard blank as the two folding bars are mutually nearable or distanceable for regulating the position thereof, and therefore the distance thereof, from the conveyor, on the basis of the effective position and width of the reinforcing flaps and of the enveloping flaps present in the two lateral sectors of the cardboard blank and which project from the sides of the conveyor.

Other advantageous and preferred characteristics of the folding station (S3) proposed by the present invention are described in the following.

The folding station (S3) comprises a first retaining member (45) of the cardboard blank (C) that is arranged at a first side of the conveyor (4), between the conveyor (4) and the first folding bar (61), and a second retaining member (46) of the cardboard blank (C) that is arranged at a second side of the conveyor (4), between the conveyor and the second folding bar (62).

The first retaining member (45) and the second retaining member (46) are positioned flanked to the conveyor (4) in a position corresponding to the position (Z) in which the conveyor (4) halts the cardboard blank (C), and are at a distance from the conveyor (4) such as to be able to abut the parts of the central sector (SC) of the cardboard blank (C) that project laterally from the conveyor (4) and constrain them during the rotation activation of the first folding bar (61) and the second folding bar (62), for the folding of the reinforcing flaps and the two folding tabs of the two lateral sectors (SL1, SL2) on the relative portions of the central sector (SC) of the cardboard blank (C).

In particular, the first retaining member (45) comprises a plate (450) provided with a series of suckers (451) for retaining the cardboard blank (C), the plate (450) being arranged parallel to the conveyor (4) and parallel to the first folding bar (61).

In turn, the second retaining member (46) comprises a plate (460) provided with a series of suckers (461) for retaining the cardboard blank (C), the plate (460) being arranged parallel to the conveyor (4) and parallel to the second folding bar (62).

In a preferred aspect of the folding station (S3), the first folding bar (61) is hinged to the plate (450) of the first retaining member (45) according to the first rotation axis (V1) parallel to the conveyor (4), while the second folding bar (62) is hinged to the plate (460) of the second retaining member (46) about the second rotation axis (V2) parallel to the conveyor (4).

The folding station (S3) further comprises first activating means (610) for activation in rotation of the first folding bar (61) about the first rotation axis (V1) with respect to the first retaining member (45) and for carrying out the folding operations, and also second activating means (620) provided for activation in rotation of the second folding bar (62) about the second rotation axis (V2) with respect to the second retaining member (46) for carrying out the relative folding operations.

For example, according to the preferred embodiment illustrated in the figures, the first activating means (610) can comprise at least a hydraulic or pneumatic piston hinged at an end thereof to the first folding bar (61), while in turn the second activating means (620) can comprise at least a hydraulic or pneumatic piston hinged at an end thereof to the second folding bar (62).

In a particularly advantageous aspect, the first retaining member (45) and the second retaining member (46) are predisposed at the two sides of the conveyor (4) so as to be movable and translatable alternatingly along a vertical direction, in such a way that they can be moved between a lower position (Pi) (see for example FIG. 4A), at which they are at a lower level than the conveyor (4), and an upper position (Ps) (see for example FIG. 4B), at which they are at the same level as the conveyor (4).

In this way, when the conveyor (4) is to be activated for the transport and movement of the cardboard blank (C) (for example from the inlet (IN) up to position (Z) in which the folding operations are to carried out, and from position (Z) up to the outlet (OUT)), the first retaining member (45) and the second retaining member (46) are brought into the lower position (Pi), while, once the conveyor (4) halts the cardboard blank (C) in the position (Z), the retaining members (45, 46) are raised into the upper position (Ps) so that they can abut and constrain portions of the central sector (SC) of the cardboard blank (C), and therefore constrain the cardboard blank (C) in order to enable activation of the two folding bars (61, 62) for carrying out the above-described folding operations.

The folding station (S3) also comprises a first frame (T1) which is arranged on a first side of the conveyor (4) and a second frame (T2) which is instead arranged on a second side of the conveyor (4), The first retaining member (45) and the first folding bar (61) are mounted on the first frame (T1), and connected to one another in the way described in the foregoing, as well as the first activating means (610) of the first folding bar (61).

The second retaining member (46) and the second folding bar (62) are mounted on the second frame (T2), and connected to one another in the way described in the foregoing, as well as the second activating means (620) of the second folding bar (62).

In particular, the first retaining member (45) is mounted on the first frame (T1) in such a way as to be able to slide and be translated alternatively along first vertical sliding guides (30) borne by the first frame (T1).

In this regard the folding station (S3) comprises first carriages (31), mounted slidably on the first vertical sliding guides (30) and connected to the first retaining member (45), and first movement organs (32) (for example constituted by a series of hydraulic or pneumatic pistons) for moving the first carriages (31) along the first vertical sliding guides (30).

Correspondingly, the second retaining member (45) is mounted on the second frame (T2) in such a way as to slide and be translated alternatingly along second vertical sliding guides (33) borne by the second frame (T2).

Second carriages (34) are also present, slidably mounted on the second vertical sliding guides (33), and second movement means (35) (for example constituted by a series of hydraulic or pneumatic pistons) for moving the second carriages (34) along the second vertical sliding guides (33).

The folding station (S3) further comprises horizontal sliding guides (48) which are arranged below the conveyor (4) and perpendicularly to the conveyor (4), on which horizontal sliding guides (48) the first frame (T1) and the second frame (T2) are slidably mounted.

The folding station (S3) further comprises movement means (9) predisposed and configured so as to translate and move the first frame (T1) and the second frame (T2) along the horizontal sliding guides (48) so as to be able to mutually near or distance them to/from one another, i.e. near or distance them to/from the conveyor (4), in order to adjust the position of the two folding bars (61, 62) on a basis of the actual position and dimensions of the two lateral sectors of the cardboard blank which project from the two sides of the conveyor.

The movement means (9) comprise a loop-wound belt (91) which is arranged below the conveyor (4), transversally of and perpendicular to the conveyor (4), and parallel to the horizontal sliding guides (48); a motor organ (90) for activating the loop-wound belt (91) in two opposite movement directions. first sliding elements (95) which are slidably coupled with the horizontal sliding guides (48) and which are constrained both to the first frame (T1) and to the loop-wound belt (91), and second sliding elements (96) which are slidably coupled with the horizontal sliding guides (48) and which are constrained both to the second frame (T2) and to the same loop-wound belt (91).

In particular, the first sliding elements (95) are constrained to the lower branch of the loop-wound belt (91), while the second sliding elements (98) are constrained to the upper branch of the loop-wound belt (91).

In this way, thanks to the activating and movement of the loop-wound belt (91) by the motor organ (90) in one direction or the other, it is possible to near or distance the first (T1) and the second frame (T2) to and from, one another, and thus near or distance the two frames, and therefore the two folding bars, to the conveyor.

In a further preferred aspect, the folding station (S3) comprises first presser elements (15) which are arranged above the conveyor (4) and situated between the abutting elements (43, 44) of the central parts (C3, C4) of the two enveloping flaps (A1, A2).

The first presser elements (15) being predisposed so as to be mobile from a raised position with respect to the conveyor (4) (see FIG. 4A), in order to enable the conveyor (4) to move the cardboard blank (C) and position it in the position (Z) between the two folding bars (61, 62), to a lowered position (see FIG. 4B) in which the first presser elements (15) are pressed against the first portion (P1) of the central sector (SC) of the cardboard blank (C) so as to maintain it flat and adherent to the conveyor (4) during activation of the two folding bars (61, 62) for carrying out the folding operations.

Upstream of the folding station (S3) on the cardboard blank (C), before being fed to the inlet (IN) of the folding station (S3), glue is applied at the portions of the central sector (SC) destined to be covered by the reinforcing flaps and/or also on the reinforcing flaps themselves in order to enable the mutual coupling and the reciprocal adherence thereof.

In this regard, with the aim of facilitating adherence and the coupling between the reinforcing flaps and the relative portions on the central sector of the cardboard blank, the folding station (S3) further comprises second presser elements (16) and third presser elements (17) which are arranged above the conveyor in a position such that, when the cardboard blank (C) is halted by the conveyor (4) in the position (Z), the second presser elements (16) are above the third portion (P3) and the fourth portion (P4) of the central sector (SC) of the cardboard blank (C), while the third presser elements (17) are above the second portion (P2) of the central sector (SC).

The second presser elements (16) and third presser elements (17) are movable between a raised position with respect to the conveyor (4) (see figures from 4A to 4D) and a lowered position (see for example FIGS. 4E and 4F) in which they press against the reinforcing flaps folded by the two folding bars above the relative portions of the central sector (SC) so as to facilitate the reciprocal coupling thereof by means of the glue previously applied thereon.

In a preferred aspect of the folding station (S3) of the invention, the first folding bar (61) comprises at least two flaps (66, 67) which are positioned distally to one another along the first folding bar (61) in relative positions such as to abut, during the activating in rotation of the first folding bar (61) for the folding operations, the first reinforcing flap (R1) and at least also the fifth reinforcing flap (R5), so as to facilitate the folding thereof on the relative portions (P2, P4) of the central sector (SC).

In the same way, the second folding bar (62) comprises at least two flaps (68, 69) which are positioned distally to one another along the first folding bar (61) in relative positions such as to abut, during the activating in rotation of the first folding bar (62) for the folding operations, the second reinforcing flap (R2) and at least also the sixth reinforcing flap (R6), so as to facilitate the folding thereof on the relative portions (P2, P4) of the central sector (SC).

The flaps present on the two folding bars are however positioned and have dimensions such as neither to abut nor strike the central parts of the two lateral enveloping flaps of the two lateral sectors of the cardboard blank, as they have to remain in a raised and lifted position.

In FIG. 4A the conveyor (4) has carried and halted a cardboard blank (C) into the position (Z) between the two folding bars (61, 62); the two retaining members (45, 46) are in the position (Pi) below the conveyor (4): the activating means (9) can possible be activated so as to mutually near or distance the two frames (T1, T2) so as to regulate the position of the two folding bars (61, 62) to the effective dimensions and width of the two lateral sectors (SL1, SL2) of the cardboard blank that project from the two sides of the conveyor (4).

Figure 4B:
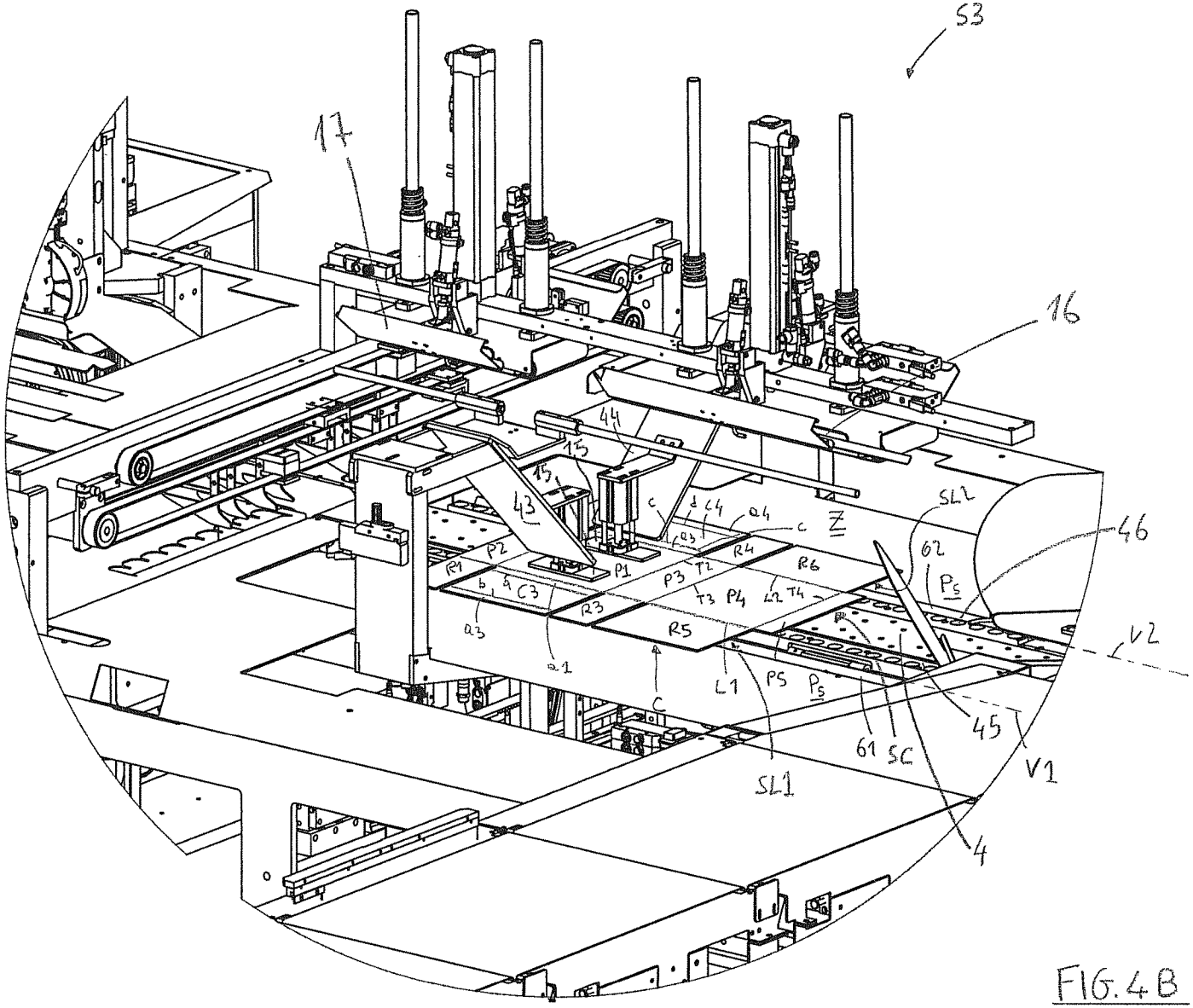

In FIG. 4B the two retaining members (45, 46) have been raised into their position (Ps) so that the relative suckers can abut and retain parts of the central sector (SC) of the cardboard blank (C) which project from the sides of the conveyor (4), while the first presser elements (15) are brought into the lowered position thereof in which the first presser elements (15) are pressed against the first portion (P1) of the central sector (SC) of the cardboard blank (C) so as to maintain it flat and adherent to the conveyor (4).

Figure 4C:
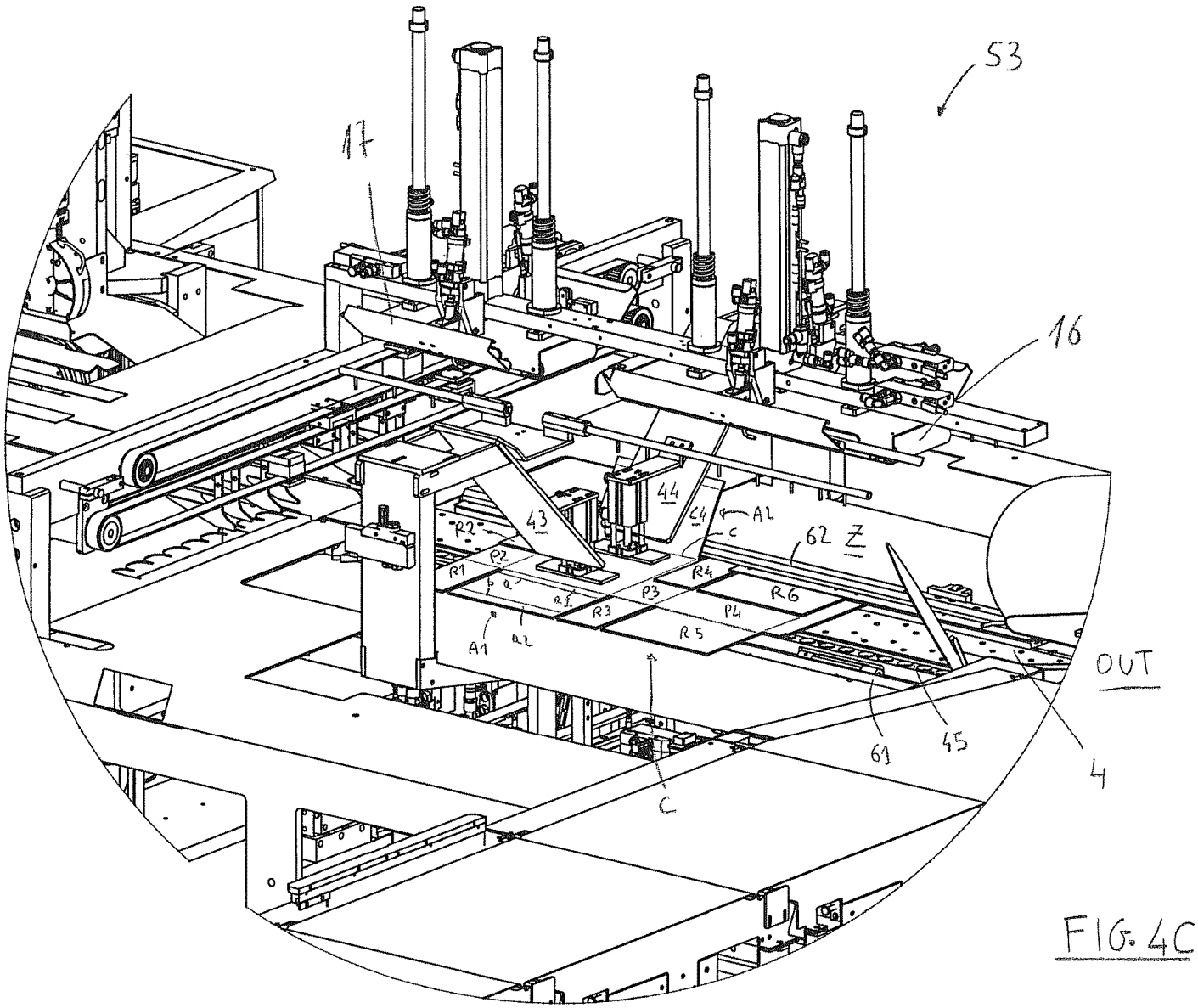

In FIG. 4C the second folding bar (62) has been activated in rotation about the relative rotation axis so as to rotate and fold: the second reinforcing flap (R2) above the second portion (P2) of the central sector (SC) of the cardboard blank (C), the third folding tab (a3) present in the second lateral enveloping flap (A2) above a part of the first portion (P1) of the central sector (SC), the fourth reinforcing flap (R4) above the third portion (P3) and the sixth reinforcing flap (R6) above the fourth portion (P4) of the central sector (SC), while the central portion (C4) of the second lateral enveloping flap (A2) abuts the abutment element (44) and is maintained in a raised position.

Figure 4D:
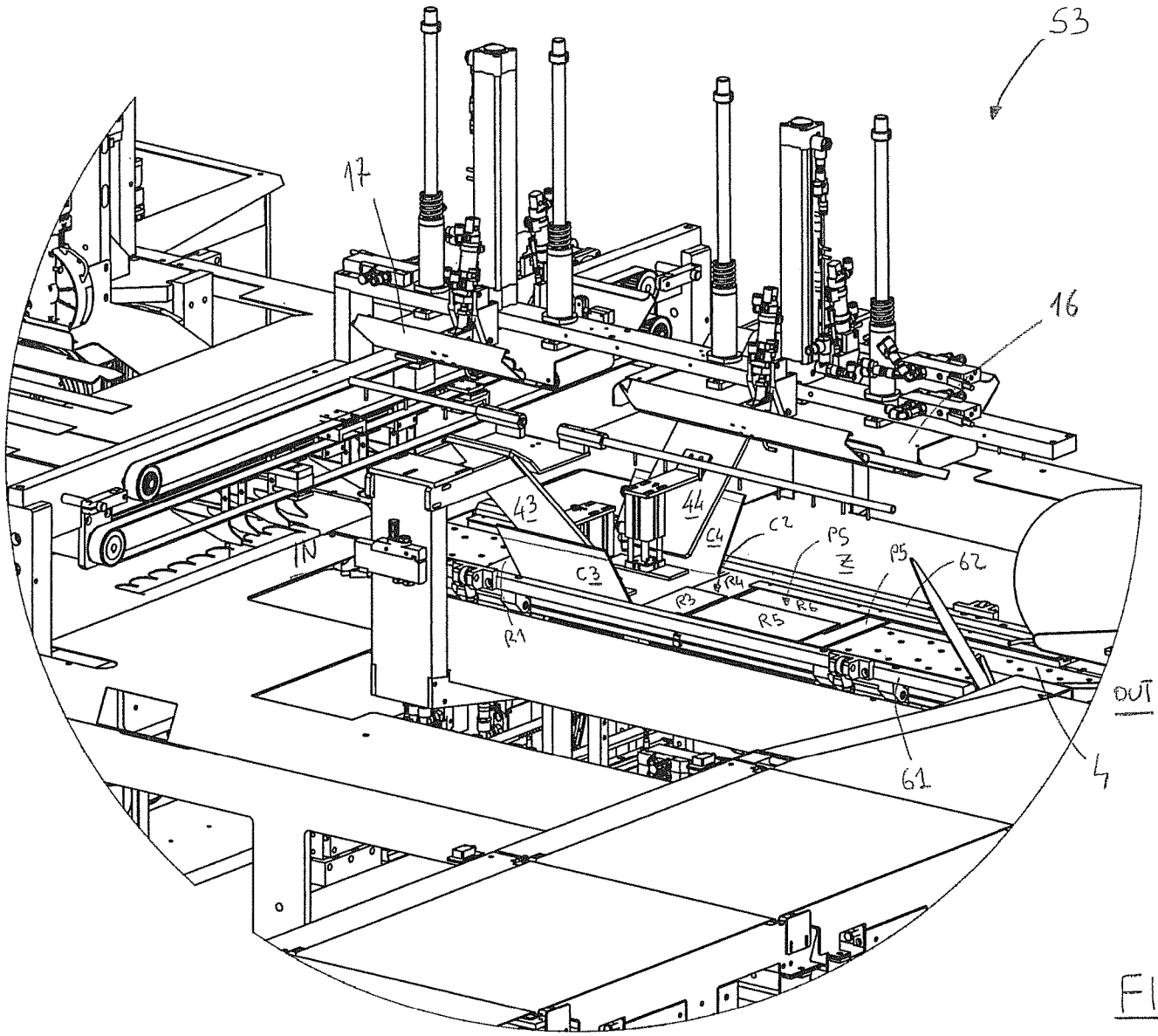

In FIG. 4D the first folding bar (61) has been activated in rotation about the relative rotation axis so as to rotate and fold: the first reinforcing flap (R1) above the second portion (P2) of the central sector (SC) of the cardboard blank (C); the first folding tab (a2) present in the first lateral enveloping flap (A1) above a part of the first portion (P1) of the central sector (SC); the third reinforcing flap (R3) above the third portion (P3) and the fifth reinforcing flap (R5) above the fourth portion (P4) of the central sector (SC), while the central portion (C3) of the first lateral enveloping flap (A1) abuts the abutment element (43) and is maintained in a raised position.

Figure 4E:
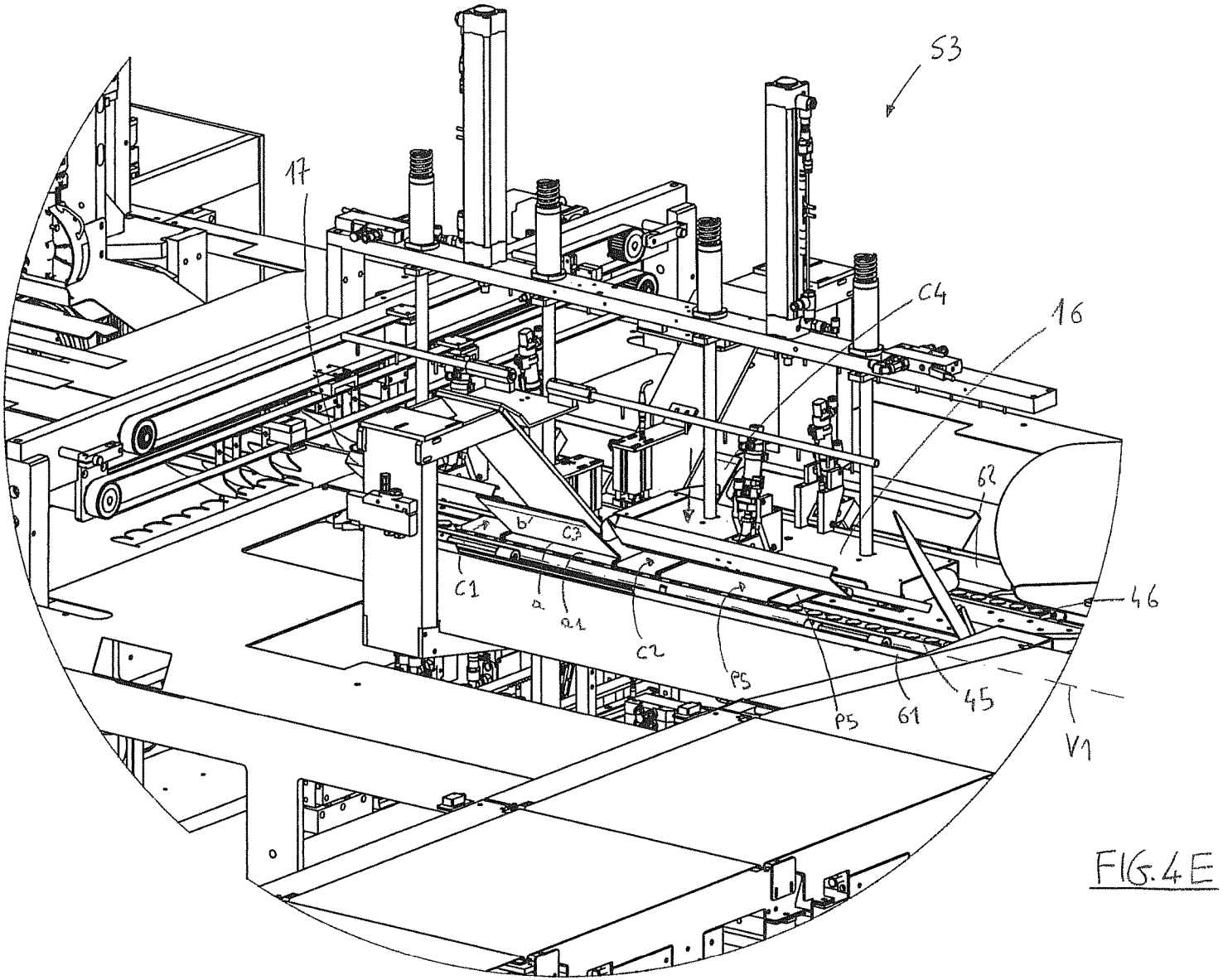

In FIG. 4E, the second presser elements (16) and the third presser elements (17) are brought into the lowered position thereof and maintained pressed against the reinforcing flaps folded by the two folding bars above the relative portions of the central sector (SC) so as to facilitate the reciprocal coupling thereof by means of the glue previously applied thereon.

Figure 4F:
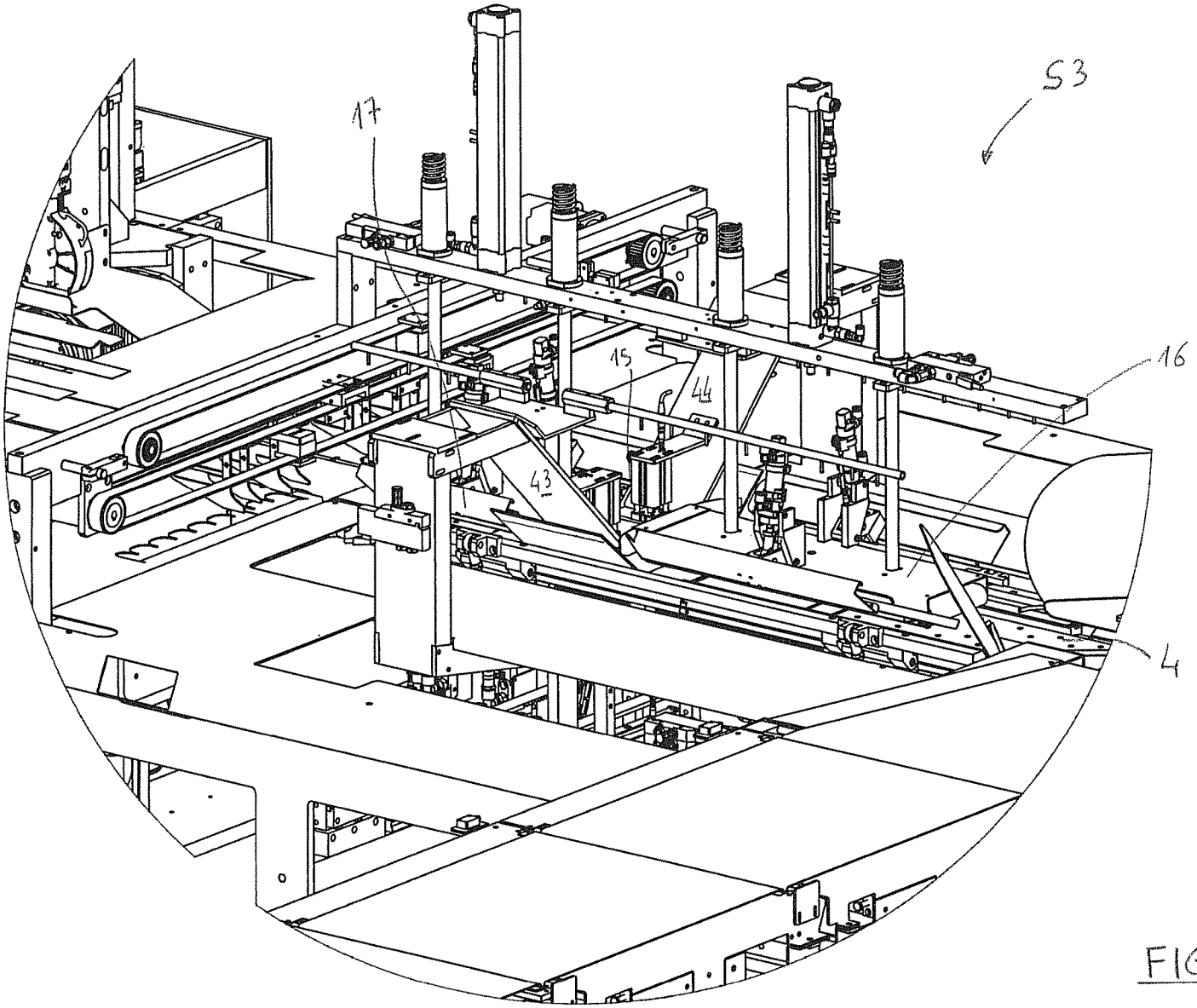
Figure 46:
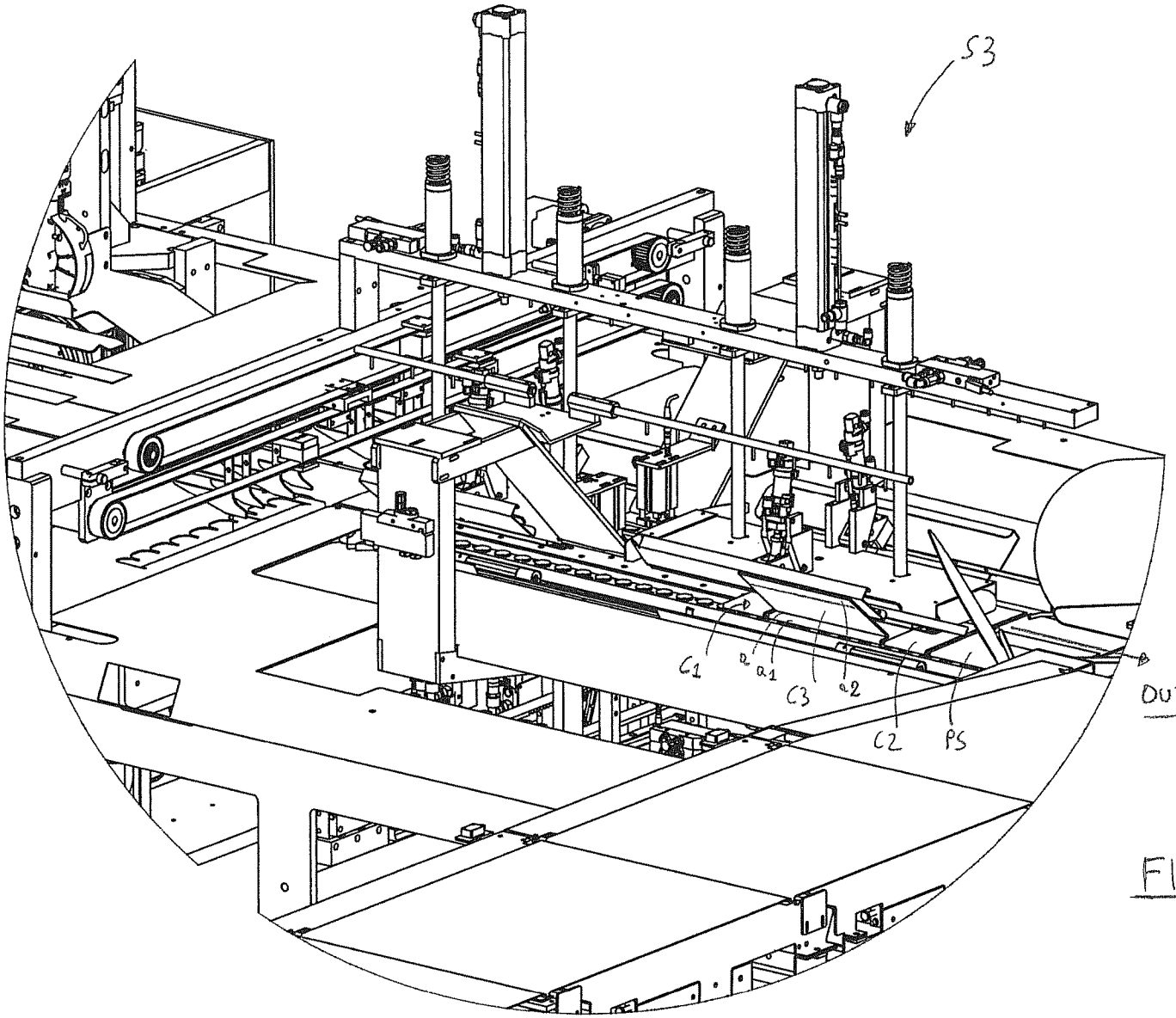

In FIG. 4F the two folding bars are activated in rotation about the relative rotation axes in an opposite direction to the preceding direction so as to be distanced from the cardboard blank.

In FIG. 4G the conveyor (4) is activated to transfer and transport the cardboard blank (C) thus partly folded to the outlet (OUT) of the folding station (S3).

As indicated in the preceding, in FIGS. 2A and 2B, in relative views from above and from the side, a layout of a machine (100) for packaging an article internally of a cardboard box is illustrated, obtained from a cardboard sheet of the present invention, and comprising the folding station (S3) described in the foregoing.

FIG. 2C and FIG. 2D schematically illustrate, in a succession of images, the various operations which the packaging machine (100) carries out starting from obtaining a cardboard sheet cut from a continuous strip of cardboard, for processing the cardboard sheet so as to obtain a cardboard blank for packaging, and the operations for wrapping the cardboard blank for packaging about an article and obtaining a closed cardboard box with the packaged article inside it.

In particular, FIG. 2C illustrates, with a series of images, some main operating steps of the machine of the invention, while FIG. 2D illustrates the complete succession of all the operating steps which the machine (100) performs for packaging an article internally of a cardboard box starting from a cardboard sheet cut from a continuous strip of cardboard, which operations include realising, starting from the cut cardboard sheet, a cardboard blank (C) such as the one illustrated in FIG. 1, and folding the cardboard blank about an article so as to package it and close it internally of a cardboard box.

The operating sequences illustrated in the succession of images in FIGS. 2C and 2D have been illustrated with reference to the packaging of two articles of different shapes and dimensions, and therefore both the cardboard blanks and the final boxes obtained in the two cases have a different shape and dimension.

This is also for demonstrating how the machine (100) of the present invention is able to package and close articles internally of the relative cardboard boxes independently of the dimensions of the articles, i.e. the machine (100) realizes the cardboard for packaging on the basis of the effective dimensions of the articles so that the blanks can be folded about the articles and obtain the relative boxes with the packaged and packed articles internally of the boxes.

The machine (100) comprises:

a store (M) in which a continuous strip of cardboard (S) is predisposed, folded in bellows fashion on itself to form a fanfold (SF);

a sectioning station (S1) of a cardboard sheet (F) from the continuous strip of cardboard (S), which sectioning station (S1) is situated downstream of the store (M), and wherein the continuous strip of cardboard (S) unwound from the fanfold (SF) is fed and advanced in an advancement direction (w) and cut so as to obtain a cardboard sheet (F) and wherein at the same time a transversal score line (T4) is realised, parallel to the cut edge on the continuous strip of cardboard (S);

a score line forming station (S1*), downstream of the sectioning station (S1), into which the cut cardboard sheet (F) is fed, corning from the sectioning station (S1), and on which cardboard sheet (F), the two longitudinal score lines (L1, L2) are realised, so as to identify, in the cardboard sheet, a central sector (SC) and two lateral sectors (SL1, SL2); and three transversal score lines (T1, T2, T3), for identifying, in the central sector (SC), together with the score line (T4) realised previously in the sectioning station (S1), the above described five portions (P1, P2, P3, P4, P5), and wherein in the portion of cardboard sheet of the two lateral sectors (SL1, SL2), two pairs of longitudinal folding lines (a, b) (c, d) are made at the flanks of the first portion (P1), which identify the first (a1), second (a2), third (a3) and fourth (a4) folding tabs of the two lateral folding flaps (A1, A2) from which the third (C3) and the fourth (C4) lateral closing walls of the cardboard blank are obtained.

In the score line forming station (S1*), the longitudinal score lines (L1, L2) and the transversal score lines (T1, T2, T3) are realised as a function of the effective dimensions of the article to be packed, in particular as a function of the dimensions of the base of the article (width L, length I) and of the height (H) of the flanks of the article.

In particular, for example, the two longitudinal score lines (L1, L2) are made at a mutual distance that is equal to the length (L) of the base of the article, the first transversal score line (T1) is made at a distance from a first transversal edge (B1) of the cardboard sheet (upstream edge with respect to the infeed direction into the score line forming station) corresponding to the height (H) of a first flank of the article, the second transversal score line (T2) is made at a distance from the first transversal score line (T1) on the basis of the width (I) of the base of the article, the third transversal score line (T3) is made at a distance from the second score line (T2) corresponding to the height (H) of the second flank of the article, opposite the first flank, and at a distance from the fourth transversal score line (T4), corresponding to the score line (T4) which had previously been realised in the sectioning station (S1), corresponding to the width (L*) of the upper face of the article.

The above-mentioned sectioning station (S1) of a cardboard sheet (F) from the continuous strip of cardboard (S) comprises: a conveyor plane (1), predisposed so as to be able to restingly receive the continuous strip of cardboard (S) which is unwound from the fanfold (F), conveying means (2), for advancing the continuous strip of cardboard (S) along the conveyor plane (1) in an advancement direction (w) and for halting the continuous strip of cardboard (S) for enabling cutting thereof, a sectioning group (3), predisposed above the conveyor plane (1), for sectioning and cutting a cardboard sheet (F) from the continuous strip of cardboard (S) and contemporaneously realising the score line (T4) in proximity of the cut edge (which will constitute the fourth score line (T4) in the cardboard sheet).

The score line forming station (S1*) comprises (FIGS. 2A, 2B):

first score line forming means (51) predisposed to realise, on the cardboard sheet (F), two longitudinal score lines (L1, L2) parallel to the advancement direction and parallel to the longitudinal edges (BL) of the cardboard sheet (F), distanced from one another by a distance corresponding to a length (L) of the base of the article to be packed, so as to identify, in the cardboard sheet (F), a central sector (SC) and two lateral sectors (SL1, SL2) (see for example the third image starting from the left in FIG. 2D);

second score line forming means (52) which are predisposed for realising, in the central sector (SC), the three transversal score lines (T1, T2, T3) parallel to one another and distanced so as to identify, in the central sector (SC), together with the fourth score line (T4) (which is the score line (T4) realised in the sectioning station (S1)), the above-mentioned five portions (P1, P2, P3, P4, P5) in the following way (see FIG. 1 and the fourth image starting from the left in FIG. 2D).

A first portion (P1), between the first transversal score line (T1) and the second transversal score line (T2) having dimensions corresponding to the base of the article to be packed;

a second portion (P2), between a first transversal edge (B1) of the cardboard sheet (F) and the first transversal score line (T1), having dimensions corresponding to a first flank of the article;

a third portion (P3), adjacent to the first portion (P1), between the second transversal score line (T2) and the third transversal score line (T3) having dimensions corresponding to a second flank of the article, opposite the first flank;

a fourth portion (P4), between the third score line (T3) and a fourth score line (T4) (which as mentioned is the score line (T4) that has been realised in the sectioning station (S1)) having dimensions corresponding to the upper face of the article;

and a fifth portion (P5) constituted by a strip of material of the cardboard sheet beyond the fourth transversal score line (T4) and up to the second transversal edge (B2) of the cardboard sheet (F), which will constitute the closing/opening tab (AC) of the cardboard box.

In particular, the second score line forming means (52) are predisposed for realising the three transversal score lines (T1, T2, T3) from a longitudinal edge (BL) to the other longitudinal edge (BL) of the cardboard sheet (F), so that the transversal score lines involve also the two lateral sectors (SL1, SL2) of the cardboard sheet (F).

The score line forming station (S1*) lastly further comprises third score line forming means (53) which are predisposed so as to realise, in the portions of the cardboard sheet (F) of the two lateral sectors (SL1, SL2), at flanks of the first portion (P1), pairs of longitudinal folding lines (a, b), (c, d) parallel to the two score lines (L1, L2) and having a same width extension as the first portion (P1).

The machine further comprises a transversal cutting station (S2), downstream of the score line forming station (S1*), into which the cardboard sheet (F) is fed in an advancement direction with the longitudinal score lines (L1, L2) and the four transversal score lines (T1, T2, T3, T4) and the pairs of folding lines (a, b), (c, d), into which cutting station (S2), for each of the two lateral sectors (SL1, SL2) four transversal cuts are made on the cardboard sheet at the four transversal score lines (T1; T2, T3, T4), each at a relative transversal score line.

The transversal cutting station (S2) will provide, at the outlet thereof, as mentioned above, a cardboard blank for packaging (C) such as the one illustrated in the foregoing and illustrated in FIG. 1, that is, with the five portions (P1, P2, P3, P4, P5) in the central sector (SC), the six reinforcing flaps (R1, R2, R3, R4, R5, R6) in the two lateral enveloping flaps (A1, A2) in the two lateral sectors (SL1, SL2) (see also FIGS. 2C and 2D).

The transversal cutting station (S2) comprises cutting means (41, 42), for example constituted by two pairs of rotary cutting dies (41, 42) arranged on both sides of the cardboard sheet (F) for carrying out four transversal cuts (11, 12, 13, 14) for each of the two lateral sectors (SL1, SL2) of the cardboard sheet (F), at the four transversal score lines (T1, T2, T3, T4), so as to obtain: at the two ends of the second portion (P2), a first reinforcing flap (R1) and a second reinforcing flap (R2); at the two ends of the first portion (P1), a first lateral enveloping flap (A1), containing the first pair of longitudinal folding lines (a, b) which identify a first folding tab (a1), between the first folding line (a) and the first longitudinal score line (L1), a second folding tab (a2) between the folding line (b) and the edge of the first enveloping flap (A1), and a central portion (C3) between the two longitudinal folding lines (a, b); and a second lateral enveloping flap (A2), containing the second pair of longitudinal folding lines (c, d) which identify a third folding tab (a3), between the folding line (c) and the second longitudinal score line (L2) a fourth folding tab (a4) between the folding line (d) and the edge of the second enveloping flap (A2) and a central portion (C4) between the two longitudinal folding lines (c, d); at the two ends of the third portion (P3), a third reinforcing flap (R3) and a fourth reinforcing flap (R4); at the two ends of the fourth portion (P4), a fifth reinforcing flap (R5) and a sixth reinforcing flap (R6); and forming, between the fourth transversal score line (T4) and the second transversal edge (B2), a tab (AC) for closing the cardboard box, so as to provide, at the outlet of the transversal cutting station (S2), a cardboard blank (C) for packing an article;

Downstream of this cutting station (S2), the machine (100) further comprises a successive series of work stations for carrying out the operations on the cardboard blank (C) that are necessary for realising the packaging of the article internally of a box obtained from the cardboard blank.

In detail, downstream of the transversal cutting station (S2), the machine (100) comprises, in succession one after another, a first folding station (S3) which is realised in the same way as the folding station (S3) described in the foregoing, a feeding station (S3*) of the article to be packed, a second folding station (S4), for the partial folding of the cardboard blank about the article, and a closing station (S5) for the final folding of the cardboard blank about the article so as to obtain a closed cardboard box with the article inside, completely packed and packaged (see FIGS. 2A, 2B).

Figure 1A:
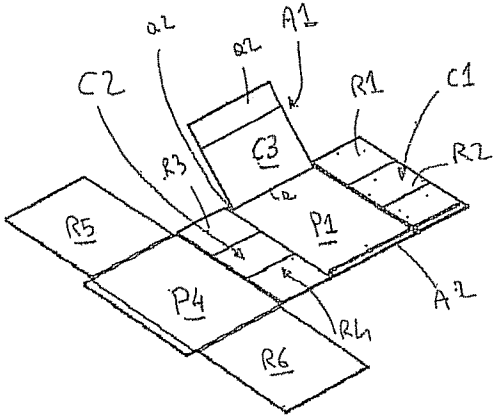

The first folding station (S3), as mentioned, is realised in the same way as the folding station (S3) described in the foregoing, is arranged downstream of the transversal cutting station (S2), into which the cardboard blank (C) is fed in an advancement direction and at which the cardboard blank (C) is halted and, simultaneously, i.e. in a single operation:

the first (R1) and second reinforcing flap (R2) are folded, with respect to the first (L1) and the second (L2) longitudinal score line, on the second portion (P2) of the central sector (SC), for obtaining the first lateral closing wall (C1);

the third (R3) and fourth reinforcing flap (R4), with respect to the first (L1) and the second (L2) longitudinal score line, on the third portion (P3) of the central sector (SC), for obtaining a second lateral closing wall (C2);

the fifth (R5) and sixth reinforcing flap (R6), with respect to the first (L1) and the second (L2) longitudinal score line, on the fourth portion (P4) of the central sector (SC), for obtaining an upper closing wall (PS);

the first folding tab (a1) of the first lateral enveloping flap (A1) is folded, with respect to the first longitudinal score line (L1), for superposing on a part of the first portion (P1) of the central sector (SC) and forming a reinforcing edge, leaving the central part (C3) of the first enveloping flap (A1) in the raised position, defining a third lateral closing wall (C3), and the third folding tab (a3) of the second lateral enveloping flap (A2) is folded, with respect to the second longitudinal score line (L2), for superposing a part of the first portion (P1) of the central sector (SC) and forming a reinforcing edge, leaving the central part (C4) of the second lateral enveloping flap (A2) in the raised position, so as to define a fourth lateral closing wall (C4) (see FIG. 1A, the fifth image from the left in FIG. 2C and the seventh image from the left in FIG. 2D).

As mentioned, these folding operations are carried out, as described in the foregoing, with the cardboard blank and simultaneously with one another, i.e. in a single action, therefore very rapidly and swiftly, required truly short pause times for the cardboard blank.

Figure 1B:
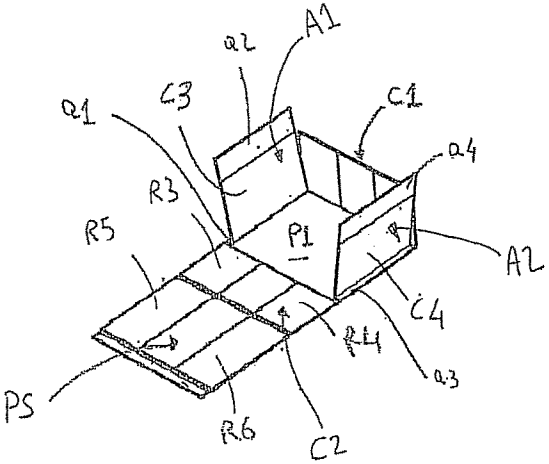
Figure 1C:
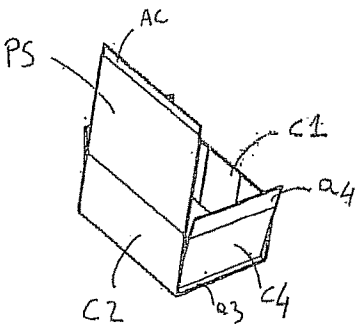
Figure 1D:
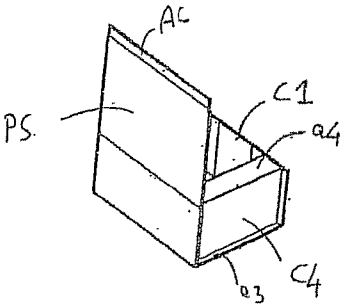
Figure 1E:
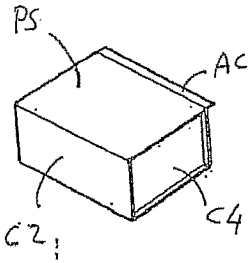
Figure 1F:
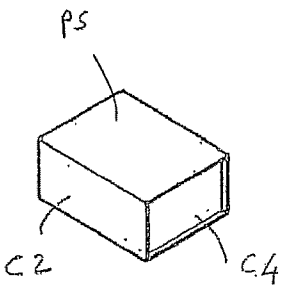

At the outlet of the first folding station (S3), the cardboard blank (C) has, formed upon it, the first lateral closing wall (C1), the second lateral closing wall (C2), the upper closing wall (PS), which all have a reinforced structure thanks to the reinforcing flaps folded and partially superposed on one another, and which are on the same plane as the first portion (P1) of the cardboard blank, while the third (C3) and fourth (C4) lateral closing wall are already partially erected and folded with respect to the central portion (P1) following the folding of the first folding tab (a1) and third folding tab (a3) above the first portion (P1), with the cardboard blank having the shape illustrated in the fifth image from the left in FIG. 2C, and also illustrated in FIG. 1B).

Downstream of this first folding station (S3), the machine (100) comprises a feeding station (S3*) of an article to be packed (see FIGS. 2A, 2B and 2D), at which an article to be packed is deposited and rested on the first portion (P1) of the cardboard blank (C) (FIG. 2D), with a first flank facing towards the first lateral closing wall (C1), a second flank, opposite the first, facing towards the second lateral closing wall (C2), a third flank, transversal to the first two, facing towards the third lateral closing wall (C3), and a fourth flank, opposite the third, facing towards the fourth lateral closing wall (C4).

At this point, the machine (100) further comprises, downstream of the inserting station of the article (S3*), a second folding station (S4) to which the cardboard blank (C) with the article rested thereon, on the first portion (P1) thereof, is fed and advanced in an advancement direction.

In the second folding station (S4), the cardboard blank (C) is advanced in the advancement direction, and while the cardboard blank (C) is in motion, at the same time (see for example the third-last image of FIG. 2C, or the pair of the flanked two third-last images of FIG. 2D):

the third lateral closing wall (C3) is folded with respect to the folding line (a) which separates it from the first folding tab (a1) so as to cover the third flank of the article, and the second folding tab (a2) is folded with respect to the score line (b) which separates it from the third lateral closing wall (C3), so as to superpose it on a part of the upper face of the article, the fourth lateral closing wall (C4) is folded with respect to the score line (c) which separates it from the third folding tab (a3) so as to cover the fourth flank of the article, and the fourth folding tab (a4) is folded with respect to the score line (d) which separates it from the fourth lateral closing wall (C4), so as to superpose it on a part of the upper face of the article.

These folding operations, as mentioned, are carried out by advancing the cardboard blank along an advancement direction, and as soon as these folding operations have been completed, the machine (100) applies glue on the second (a2) and fourth (a4) folding tabs folded onto the upper face of the article.

The machine (100) also includes, again in the second folding station (S4), and once the glue has been applied, halting the cardboard blank and (see for example the penultimate image of FIG. 2 or the pair of the two penultimate images of FIG. 2D):

rotating the second lateral closing wall (C2), with respect to the second transversal score line (T2), so as to fold it with respect to the first portion (P1) on which the article (for example folded by 90°) is rested up to when it goes to cover the second flank of the article.

and then, in sequence, rotating the upper closing wall (PS), with respect to the third transversal score line (T3), so as to fold it with respect to the second lateral closing wall (C2) (for example folded by 90°) up to when it goes to cover the upper face of the article.

For this purpose, the machine (100) comprises, in this second folding station (S3) (see FIGS. 2A, 2B):

first folding means (71) for rotating the third lateral closing wall (C3), with respect to the folding line (a) which separates it from the first folding tab (a1), and folding the third lateral closing wall (C3) up to when it goes to cover the third flank of the article, and for rotating the second folding tab (a2), with respect to the score line (b) which separates it from the third lateral closing wall (C3), and folding the second folding tab (a2) up to superposing it on a part of the upper face of the article;

second folding means (72) for rotating the fourth lateral closing wall (C4), with respect to the score line (c) which separates it from the third folding tab (a3), and folding the fourth lateral closing wall (C4) up to when it goes to cover the fourth flank of the article, and for rotating the fourth folding tab (a4), with respect to the score line (d) which separates it from the fourth lateral closing wall (C4), so as to fold the fourth folding tab (a4) up to superposing it on a part of the upper face of the article;

means for applying glue (73) predisposed for applying glue on the second (a2) and fourth (a4) folding tab folded onto the upper face of the article;

blocking means (74), for blocking and halting the cardboard blank (C) once the means for applying glue (74) have applied the glue, third folding means (75) for rotating the second lateral closing wall (C2), with respect to the second transversal score line (T2), so as to fold it with respect to the first portion (P1) on which the article is rested up to when it goes to cover the second flank of the article, and fourth folding means (76) for rotating, in succession, following the folding of the second lateral closing wall (C2), the upper closing wall (PS) with respect to the third transversal score line (T3), so as to fold it with respect to the second lateral closing wall (C2) up to when it goes to cover the upper face of the article, and therefore provide in outlet from the second folding station (S4) a cardboard box (SCA) partially closed with the packed article internally thereof;

At this point, the article is almost completely enveloped in the folded cardboard blank and the almost concluded packaging box.

The machine (100), therefore, transfers the cardboard blank (C), partly folded about the article in the above-described way, to the final closing station (S5), situated downstream of the second folding station (S4), at which the cardboard blank is halted, the first lateral closing wall (C1) is rotated with respect to the first transversal score line (T1) and folded with respect to the first portion (P1) (for example by 90°) so that it goes to cover the first flank of the article; at the same time as the folding of the first lateral closing wall (C1), glue is applied on the upper part of the first lateral closing wall (C1) (see the image on the left of the pair of last two images of FIG. 2D).

Lastly, following the completion of these operations, the machine (100), while still keeping the cardboard blank stationary in the final closing station (S5), rotates the closing tab (AC) with respect to the fourth transversal score line (T4), and folds the closing tab (AC) with respect to the upper wall (PS) (for example by 90°) against the upper part of the first lateral closing wall (C1), to make it adhere thereto and complete the closure of the cardboard box with the packaged article internally thereof (see the last image of FIG. 2C and the image on the right of the pair of two further images of FIG. 2D).

For this purpose, the machine (100), in this final closing station (S5), comprises (see FIGS. 2A, 2B):

stop means (8) activatable for halting the cardboard box (SCA);

fifth folding means (81) predisposed for being activated once the box (SCA) has been halted for rotating the first lateral closing wall (C1), with respect to the first transversal score line (T1), so as to fold it with respect to the first portion (P1) on which the article is rested so that it goes to cover the first flank of the article;

a glue applying organ (82), functionally associated to the fifth folding means (81), and predisposed for applying glue on a part of the first lateral closing wall (C1) while it is folded by the fifth folding means (81) against the first flank of the article, and sixth folding means (83) activatable for rotating the closing tab (AC) with respect to the fourth transversal score line (T4), and folding the closing tab (AC) with respect to the upper wall (PS) against the upper part of the first lateral closing wall (C1) on which the glue had been applied, in order to make it adhere thereto and complete the closing of the cardboard box (SCA) with the article packed internally thereof, and thus provide at the outlet of the final closing station (S5) a cardboard box (SCA) completely closed with the packed article internal thereof.

The machine (100) then transfers the cardboard box, with the packaged article inside, to the outlet of the final closing station (S5), so that the cardboard box can be collected and directed towards a station for management and dispatch of orders.

The machine (100) further comprises, between the transversal cutting station (S2) and the first folding station (S3), also a trimming station (S2*), in which the cardboard blank can be trimmed along the longitudinal edges so as to adapt the width of the reinforcing flaps (R1, R2, R3, R4, R5, R6) to the effective dimensions of the second (P2), third (P3) and fourth portion (P4), so that the reinforcing flaps can effectively be folded above the portions, and at least partially superposed on one another, so as to adapt the width of the two lateral folding flaps (A1, A2), to the effective dimension of the third flank and fourth flank of the article.

The machine (100) also comprises, again between the transversal cutting station (S2) and the first folding station (S3), downstream of the trimming station (S2*), a glue applying station (S2) comprising means for applying glue at least on reinforcing flaps (R1, R2, R3, R4, R5, R6) and/or on the second portion (P2), third portion (P3) and fourth portion (P4), on which the reinforcing flaps (R1, R2, R3, R4, R5, R6) have to be folded in the following first folding station (S3**).

The invention claimed is:

1. A folding station for folding a cardboard blank for packing, comprising an inlet and an outlet and predisposed to receive at the inlet thereof a cardboard blank for packing having two transversal edges and two longitudinal edges and which is such as to comprise two longitudinal score lines, from a first transversal edge to a second transversal edge, and four transversal score lines from a longitudinal edge to the other longitudinal edge, the two longitudinal score lines being parallel to one another and parallel to the longitudinal edges and at a reciprocal distance from one another corresponding to the length of a base of an article to be packaged and packed with the cardboard blank, and defining, in the cardboard blank, a central sector, between the two longitudinal score lines, and two lateral sectors externally of the two longitudinal score lines, the four transversal score lines being parallel to one another and parallel to the transversal edges, and which comprise, starting from the first transversal edge of the cardboard blank:

a first transversal score line at a distance from the first transversal edge of the cardboard blank corresponding to the height of a first lateral flank of the article to be packaged and packed with the cardboard blank;

a second transversal score line at a distance from the first transversal score line corresponding to a width of the base of the article;

a third transversal score line at a distance from the second transversal score line corresponding to a height of a second flank of the article, parallel and opposite the first flank;

a fourth transversal score line at a distance from the third transversal score line corresponding to a width of the upper face of the article to be packed;

the cardboard blank received at the inlet of the folding station therefore having, in the central sector, five portions defined by the four transversal score lines and comprising:

a first portion, between the first transversal score line and the second transversal score line;

a second portion, between the first transversal edge of the cardboard blank and the first transversal score line, adjacent to the first portion and hinged thereto by means of the first transversal score line;

a third portion, between the second transversal score line and the third transversal score line, adjacent to the first portion and hinged thereto by means of the second transversal score line;

a fourth portion, between the third transversal score line and the fourth transversal score line, adjacent to the third portion and hinged thereto by means of the third transversal score line;

a fifth portion between the fourth transversal score line and the second transversal edge of the cardboard blank, the cardboard blank received at the inlet of the folding station which further comprises, in each of the two lateral sectors, four cuts, which extend from the longitudinal edges of the cardboard blank up to reaching the two longitudinal score lines, and which are realised at the four transversal score lines so that, in the two lateral sectors the cardboard blank comprises:

between the first transversal edge of the cardboard blank and the transversal cuts realised at the first transversal score line a first reinforcing flap hinged, via the first longitudinal score line, to a first end of the second portion, and a second reinforcing flap hinged, via the second longitudinal score line, to a second end of the second portion;

between the transversal cuts realised at the second transversal score line and the transversal cuts realised at the third transversal score line: a third reinforcing flap hinged, via the first longitudinal score line, to a first end of the third portion, and a fourth reinforcing flap hinged, via the second longitudinal score line, to a second end of the third portion;

between the transversal cuts realised at the first transversal score line and the transversal cuts realised at the second transversal score line: a first lateral enveloping flap hinged, via the first longitudinal score line, to a first end of the first portion, and a second lateral enveloping flap hinged, via the second longitudinal score line, to a second end of the first portion;

between the transversal cuts realised at the third transversal score line and the transversal cuts realised at the fourth transversal fold line: a fifth reinforcing flap hinged, via the first longitudinal score line, to a first end of the fourth portion, and a sixth reinforcing flap hinged, via the second longitudinal score line, to a second end of the fourth portion;

the cardboard blank further comprising, in the first lateral enveloping flap, a pair of longitudinal folding lines, parallel and realised at a distance such that a central part is defined between the two longitudinal folding lines, and a first folding tab, hinged to the first longitudinal score line, between the central part and the first longitudinal score line, and a second folding tab, between the central part and a longitudinal edge of the cardboard blank, are also defined, and in the second lateral enveloping flap a pair of longitudinal folding lines, parallel and realised at a distance such that an additional central part is defined on the second lateral enveloping flap, between the two longitudinal folding lines; and a third folding tab, hinged to the second longitudinal score line, between the central part and the second longitudinal score line, and a fourth folding tab, between the central part and the second longitudinal edge of the cardboard blank, are also defined, the folding station being characterised in that it comprises:

a conveyor which extends from the inlet to the outlet and which is able to restingly receive the cardboard blank, with the first transversal edge and therefore the first transversal score line being arranged upstream of and transversal to the conveyor, and the second transversal edge, and therefore the fourth transversal fold line, being arranged downstream and transversal to the conveyor and with the two longitudinal edges parallel to the conveyor, the conveyor being dimensioned and predisposed so that the cardboard blank is arranged thereon resting with at least a part of the central sector thereof, and with the two lateral sectors projecting laterally beyond the two sides of the conveyor, the conveyor being activatable for conveying and transporting the cardboard blank in an advancement direction, until halting it in a given position between the inlet and the outlet;

a first folding bar located by a flank of a first side of the conveyor at the position in which the conveyor halts the cardboard blank;

a second folding bar located by a flank of a second side of the conveyor at the position in which the conveyor halts the cardboard blank;

the first folding bar which is arranged parallel to the conveyor and is predisposed so as to be swivellable and rotatable according to a first rotation axis parallel to the conveyor, i.e. to the advancement direction of the conveyor, the second folding bar which is in turn arranged parallel to the conveyor and is predisposed so as to be swivellable and rotatable according to a second rotation axis parallel to the advancement direction of the conveyor;

the first folding bar and the second folding bar being arranged at the two sides of the conveyor so as to be translatable according to a perpendicular direction to the conveyor so as to be mutually neared or distanced to or from one another, so that they can be neared to or distanced from the conveyor, in order to adjust the position thereof to the actual position and dimensions of the two lateral sectors of the cardboard blank which project from the sides of the conveyor, the first folding bar and the second folding bar being activatable in sequence so as to be rotated about the relative rotation axes so that the first folding bar is rotatable about the first rotation axis in order to abut the first reinforcing flap, the first folding tab of the first lateral enveloping flap, the third reinforcing flap and the fifth reinforcing flap present in the first lateral sector of the cardboard blank, and to rotate them about the first longitudinal score line so as to fold and arrange them respectively:

the first reinforcing flap above the second portion of the central sector;

the first folding tab above a part of the first portion of the central sector;

the third reinforcing flap above the third portion of the central sector; and the fifth reinforcing flap above the fourth portion of the central sector, and that the second folding bar is rotatable about the second rotation axis in order to abut the second reinforcing flap, the third folding tab of the second lateral enveloping flap, the fourth reinforcing flap and the sixth reinforcing flap present in the second lateral sector of the cardboard blank, and to rotate them about the second longitudinal score line so as to fold and arrange them respectively:

the second reinforcing flap above the second portion of the central sector;

the third folding tab above a part of the first portion of the central sector;

the fourth reinforcing flap above the third portion of the central sector; and the sixth reinforcing flap above the fourth portion of the central sector, and further comprising abutting elements which are located above the conveyor in a position that is such as to be abutted, during the rotation and folding of the first folding tab and of the third folding tab above the first portion of the central sector of the cardboard blank, by the central part of the first lateral enveloping flap and by the central part of the second enveloping flap in such a way as to constrain them and maintain them in a raised position and raised with respect to the relative longitudinal folding line with which they are hinged respectively to the first folding tab and the third folding tab.

2. The folding station of claim 1, further comprising a first retaining member of the cardboard blank that is arranged at a first side of the conveyor, between the conveyor and the first folding bar, and a second retaining member of the cardboard blank that is arranged at a second side of the conveyor, between the conveyor and the second folding bar, the first retaining member and the second retaining member being positioned at the two sides of the conveyor in a position corresponding to the position in which the conveyor halts the cardboard blank, and being at a distance from the conveyor such as to be able to abut the parts of the central sector of the cardboard blank that project laterally from the conveyor and constrain them during the rotation activation of the first folding bar and the second folding bar, for the folding of the reinforcing flaps and the two folding tabs of the two lateral sectors on the relative portions of the central sector of the cardboard blank.

3. The folding station of claim 2, wherein the first retaining member comprises a plate provided with a series of suckers for retaining the cardboard blank, the plate being arranged parallel to the conveyor and parallel to the first folding bar, and in that the second retaining member comprises a plate provided with a series of suckers for retaining the cardboard blank, the plate being arranged parallel to the conveyor and parallel to the second folding bar.

4. The folding station of claim 3, wherein the first folding bar is hinged to the plate of the first retaining member according to the first rotation axis parallel to the conveyor, and the second folding bar is hinged to the plate of the second retaining member according to the second rotation axis parallel to the conveyor.

5. The folding station of claim 4, further comprising first activating means for activation in rotation of the first folding bar about the first rotation axis with respect to the first retaining member for carrying out the folding operations, and second activating means for activation in rotation of the second folding bar about the second rotation axis with respect to the second retaining member for carrying out the relative folding operations.

6. The folding station of claim 2, wherein the first retaining member and the second retaining member are predisposed at the two sides of the conveyor so as to be movable and translatable alternatingly along a vertical direction, in such a way that they can be moved between a lower position, at which they are at a lower level than the conveyor, and an upper position, at which they are at the same level as the conveyor, in this way, when the conveyor is to be activated for transport and movement of the cardboard blank, the first retaining member and the second retaining member are brought into the lower position while, once the conveyor halts the cardboard blank in the position, the retaining members are brought into the upper position so that they can abut and constrain portions of the central sector of the cardboard blank, and therefore constrain the cardboard blank in order to enable activation of the two folding bars for carrying out the folding operations.

7. The folding station of claim 2, further comprising a first frame which is arranged on a first side of the conveyor and a second frame which is instead arranged on a second side of the conveyor, the first retaining member, the first folding bar hinged thereto, and the first activating means for rotating the first folding bar being predisposed and mounted on the first frame, the second retaining member, the second folding bar hinged thereto, and the second activating means for rotating the second folding bar being predisposed and mounted on the second frame.

8. The folding station of claim 7, wherein the first retaining member is mounted on the first frame in such a way as to slide and be translated alternatively along first vertical sliding guides borne by the first frame, and wherein the second retaining member is mounted on the second frame in such a way as to slide and be translated alternatively along second vertical sliding guides borne by the second frame, further comprising:

first carriages, mounted slidably on the first vertical sliding guides and connected to the first retaining member, and first movement means for moving the first carriages along the first vertical sliding guides; and second carriages, slidably mounted on the second vertical sliding guides, and second movement means for moving the second carriages along the second vertical sliding guides.

9. The folding station of claim 7, further comprising horizontal sliding guides which are arranged below the conveyor and perpendicularly to the conveyor, on which horizontal sliding guides the first frame and the second frame are slidably mounted; movement means predisposed and configured so as to translate and move the first frame and the second frame along the horizontal sliding guides so as to be able to mutually near or distance them to/from one another, i.e. near or distance them to/from the conveyor, in order to adjust the position of the two folding bars on a basis of the actual position and dimensions of the two lateral sectors of the cardboard blank which project from the two sides of the conveyor.

10. The folding station of claim 9, wherein the movement means comprise a loop-wound belt which is arranged below the conveyor, transversally of and perpendicular to the conveyor, and parallel to the horizontal sliding guides; a drive member for activating the loopwound belt according to two opposite movement directions; first sliding elements which are slidably coupled with the horizontal sliding guides and which are constrained both to the first frame and to a first branch of the loop-wound belt, and second sliding elements which are slidably coupled with the horizontal sliding guides and which are constrained both to the second frame and to a second branch of the same loop-wound belt, opposite the first branch.

11. The folding station of claim 1, further comprising first presser elements which are arranged above the conveyor and situated between the abutting elements of the central parts of the two enveloping flaps; the first presser elements being predisposed so as to be mobile from a raised position with respect to the conveyor, in order to enable the conveyor to move the cardboard blank and position it in the position between the two folding bars, to a lowered position in which the first presser elements are pressed against the first portion of the central sector of the cardboard blank so as to maintain it flat and adherent to the conveyor during rotation activation of the two folding bars for carrying out the folding operations.

12. The folding station of claim 11, further comprising second presser elements and third presser elements which are arranged above the conveyor in a position such that, when the cardboard blank is halted by the conveyor in the position, the second presser elements are above the third portion and the fourth portion of the central sector of the cardboard blank, while the third presser elements are above the second portion of the central sector, the second presser elements and third presser elements being movable between a raised position with respect to the conveyor and a lowered position in which they press against the reinforcing flaps folded by the two folding bars above the relative portions of the central sector so as to facilitate the reciprocal coupling thereof by means of an adhesive substance applied thereon upstream of the inlet of the folding station.

13. A machine for packing an article internally of a cardboard box obtained from a cardboard sheet, comprising:

a store in which a continuous strip of cardboard is predisposed, folded on itself to form a fanfold;

a sectioning station of a cardboard sheet from the continuous strip of cardboard, which sectioning station is situated downstream of the store and comprising: a conveyor plane, predisposed so as to be able to restingly receive the continuous strip of cardboard which is unwound from the fanfold, conveying means, for advancing the continuous strip of cardboard along the conveyor plane in an advancement direction and for halting the continuous strip of cardboard for enabling cutting thereof, a sectioning group, predisposed above the conveyor plane, for sectioning the cardboard sheet from the continuous strip of cardboard, forming a cut edge of the cardboard sheet and at the same time realising a first-formed transversal score line, parallel to the cut edge of the cardboard sheet;

a score line forming station, downstream of the sectioning station, into which the cut cardboard sheet coming from the sectioning station is fed, and advanced in the advancement direction, comprising: first score line forming means predisposed to realise, on the cardboard sheet, two longitudinal score lines parallel to the advancement direction and parallel to longitudinal edges of the cardboard sheet, distanced from one another by a distance corresponding to a length of the base of the article to be packed, so as to identify, in the cardboard sheet, a central sector and two lateral sectors;

second score line forming means that are predisposed for realising three additional transversal score lines parallel to one another, and parallel to the first-formed transversal score line, and mutually distanced so as to define, in the central sector, together with the first-formed transversal score line, five portions: a first portion, between the first additional transversal score line and the second additional transversal score line having dimensions corresponding to the base of the article to be packed; a second portion, between a first transversal edge of the cardboard sheet and the first additional transversal score line, having dimensions corresponding to a first flank of the article; a third portion, adjacent to the first portion, between the second additional transversal score line and the third additional transversal score line having dimensions corresponding to a second flank of the article, opposite the first flank; a fourth portion, between the third additional transversal score line and the first-formed transversal score line, having dimensions corresponding to the upper face of the article; and a fifth portion constituted by a strip of material of the cardboard sheet between the first-formed transversal score line and a second transversal edge of the cardboard sheet; and third score line forming means which are predisposed so as to realise, in the portions of the cardboard sheet of the two lateral sectors, at flanks of the first portion, a first pair of longitudinal folding lines and a second pair of longitudinal folding lines, parallel to the two longitudinal score lines and having a same width extension as the first portion, a transversal cutting station, downstream of the score line forming station, into which the cardboard sheet is fed in an advancement direction with the longitudinal score lines in the central sector, the first-formed transversal score line and the three additional transversal score lines and the pairs of folding lines, in the two lateral sectors, comprising cutting means for carrying out four transversal cuts for each of the two lateral sectors of the cardboard sheet, at the first-formed transversal score line and the three additional transversal score lines, so as to obtain: at the two ends of the second portion, a first reinforcing flap and a second reinforcing flap; at the two ends of the first portion, a first lateral enveloping flap, containing the first pair of longitudinal folding lines which identify a first folding tab between the longitudinal folding lines of the first pair and the first longitudinal score line, a second folding tab between the longitudinal folding lines of the first pair and the edge of the first enveloping flap, and a central portion between the two longitudinal folding lines of the first pair, and a second lateral enveloping flap, containing the second pair of longitudinal folding lines which identify a third folding tab, between the longitudinal folding lines of the second pair and the second longitudinal score line, a fourth folding tab between the longitudinal folding line s of the second pair and the edge of the second enveloping flap and a central portion between the two longitudinal folding lines of the second pair; at the two ends of the third portion, a third reinforcing flap and a fourth reinforcing flap; at the two ends of the fourth portion, a fifth reinforcing flap and a sixth reinforcing flap; and forming, between the fourth first-formed transversal score line and the second transversal edge, a tab for closing the cardboard box, so as to provide, at the outlet of the transversal cutting station, a cardboard blank for packing an article;

a first folding station, downstream of the transversal cutting station, into which the cardboard blank is fed in an advancement direction, and at which: the first reinforcing flap and second reinforcing flap are folded, with respect to the first and the second longitudinal score line, on the second portion of the central sector, for obtaining a first lateral closing wall; the third reinforcing flap and fourth reinforcing flap are folded, with respect to the first and the second longitudinal score line, on the third portion of the central sector, for obtaining a second lateral closing wall; the fifth reinforcing flap and sixth reinforcing flap are folded, with respect to the first and the second longitudinal score line, on the fourth portion of the central sector, for obtaining an upper closing wall; the first folding tab of the first lateral enveloping flap is folded, with respect to the first longitudinal score line, for superposing a part of the first portion of the central sector and forming a reinforcing edge, leaving the central part of the first lateral enveloping flap in the raised position, defining a third lateral closing wall, and the third folding tab of the second lateral enveloping flap is folded, with respect to the second longitudinal score line, for superposing a part of the first portion of the central sector and forming a reinforcing edge, leaving the central part of the second lateral enveloping flap in the raised position, so as to define a fourth lateral closing wall, a feeding station of an article to be packed, to which the cardboard blank coming from the first folding station is fed and wherein the article to be packed is deposited and rested on the first portion of the cardboard blank, with a first flank facing towards the first lateral closing wall, a second flank, opposite the first, facing towards the second lateral closing wall, a third flank, transversal to the first two, facing towards the third lateral closing wall, and a fourth flank, opposite the third, facing towards the fourth lateral closing wall;

a second folding station at which the cardboard blank with the article rested thereon, on the first portion thereof, is fed and advanced in the advancement direction, comprising: first folding means for rotating the third lateral closing wall, with respect to the folding line which separates it from the first folding tab, and folding the third lateral closing wall up to when it goes to cover the third flank of the article, and for rotating the second folding tab, with respect to the fold line which separates it from the third lateral closing wall, and folding the second folding tab up to superposing it on a part of the upper face of the article; second folding means for rotating the fourth lateral closing wall, with respect to the folding line which separates it from the third folding tab, and folding the fourth lateral closing wall up to when it goes to cover the fourth flank of the article, and for rotating the fourth folding tab, with respect to the fold line which separates it from the fourth lateral closing wall, so as to fold the fourth folding tab up to superposing it on a part of the upper face of the article; means for applying glue predisposed for applying glue on the second and fourth folding tab folded onto the upper face of the article; blocking means, for blocking and halting the cardboard blank once the means for applying glue have applied the glue; third folding means for rotating the second lateral closing wall, with respect to the second transversal fold score, so as to fold it with respect to the first portion on which the article is rested up to when it goes to cover the second flank of the article, and fourth folding means for rotating, in succession, the upper closing wall, with respect to the third additional transversal score line, for folding it with respect to the second lateral closing wall up to when it goes to cover the upper face of the article, and therefore provide in outlet from the second folding station a cardboard box partially closed with the packed article internally thereof;

a final closing station, situated downstream of the second folding station, to which the partially-closed cardboard box is fed, and comprising: stop means activatable for halting the partially-closed cardboard box; fifth folding means predisposed for being activated once the partially-closed cardboard box has been halted for rotating the first lateral closing wall, with respect to the first additional transversal score line, so as to fold it with respect to the first portion on which the article is rested so that it goes to cover the first flank of the article;

a glue applying organ, functionally associated to the fifth folding means, and predisposed for applying glue on a part of the first lateral closing wall while it is folded by the fifth folding means against the first flank of the article, and sixth folding means activatable for rotating the closing tab, with respect to the first-formed transversal fold line, and folding the closing tab with respect to the upper closing wall against the upper part of the first lateral closing wall on which the glue had been applied, in order to make it adhere thereto and complete the closing of the cardboard box with the article packed internally thereof, in order to provide at the outlet of the final closing station the cardboard box completely closed with the packed article internal thereof.

* * * * *